United States Patent [19]

Tada et al.

[11] Patent Number: 4,945,256

[45] Date of Patent: Jul. 31, 1990

[54] DEVICE FOR PRODUCING EVEN CLOSING OF A CIRCUIT BREAKER

[75] Inventors: Shoji Tada; Toshiko Sugio; Kuniaki Nakashima, all of Amagasaki, Japan

[73] Assignee: Mitsubishi Denki Kabushiki Kaisha, Tokyo, Japan

[21] Appl. No.: 215,955

[22] Filed: Jul. 7, 1988

[30] Foreign Application Priority Data

Jul. 9, 1987 [JP] Japan ..... 62-171481
Nov. 16, 1987 [JP] Japan ..... 62-289965
Jan. 21, 1988 [JP] Japan ..... 63-11206

[51] Int. Cl.[5] ..... H01H 47/00

[52] U.S. Cl. ..... 307/139; 307/117; 307/132 R; 361/115; 200/61.02; 371/25.1

[58] Field of Search ..... 361/93-115, 361/116; 307/139, 140, 132 R, 116, 117; 364/481; 371/25; 200/61.02

[56] References Cited

U.S. PATENT DOCUMENTS 4,016,384 4/1977 LeRow, Jr. et al. ..... 200/148 R
4,204,425 5/1980 Mallick, Jr. ..... 364/481
4,270,809 6/1981 Ohmori et al. ..... 371/25
4,513,208 4/1985 Kamata ..... 307/139
4,562,358 12/1985 Hösel ..... 200/83 R
4,670,812 6/1987 Doerfler et al. ..... 361/94

*Primary Examiner*—A. D. Pellinen
*Assistant Examiner*—Jeffrey A. Gaffin
*Attorney, Agent, or Firm*—Lowe, Price, LeBlanc, Becker & Shur

[57] ABSTRACT

A circuit breaker for opening and closing contacts disposed on each phase of a multiphase electric power line has a photo-diode array and a light emitting diode array disposed on opposite sides of a driving rod of a driving mechanism, with a light passing aperture provided in the driving rod. When the aperture in the rod crosses the respective light paths between the photo-diodes and the corresponding light emitting diodes, the photo-diodes issue electric output signals corresponding to movement of the driving rod. By processing these output signals, any abnormal breaking of the breaker contacts among the phases is detected.

7 Claims, 28 Drawing Sheets

DEVICE FOR PRODUCING EVEN CLOSING OF A CIRCUIT BREAKER

FIELD OF THE INVENTION AND RELATED ART STATEMENT

1. FIELD OF THE INVENTION

The present invention relates to an improvement to a circuit breaker, and more particularly one relates to capable of detection of undesirable movement for a ensuring oven closing of a circuit breaker.

2. DESCRIPTION OF THE RELATED ART

In closing operation of circuit breaker, uneven closing may occur when plural contacts disposed on three phases of a set of electric power lines are not closed at the same time, due to problems in driving apparatus or the like (such a condition is hereinafter referred to as "open phase"). When the open phase occurs, unbalanced electric currents flow in the phases of the power line system. And also, when an operation force is applied to a driving rod of a circuit breaker which cannot be operated, the driving rod may be broken out. Therefore, it is necessary to detect the occurrence of the open phase and to cause a tripping operation to the circuit breaker (hereinafter, abbreviated as "correction trip") in such a situation.

A circuit for correction trip of a conventional circuit breaker, for example, as shown in a book "Circuit Breaker and Lighting Discharger", USHIO, OHKI, p148 published by Denkidaigaku-Shuppankyoku, is shown in FIG. 21 and FIG. 22.

In FIG. 21, a contact 4 is closed and open by movement of a driving rod 8 which is connected to a driving mechanism 10. In response to the movement of the driving mechanism 10, a pallet-shaped contact a1 is opened and a pallet-shaped contact b1 is closed, for example, on a phase of power line at a position where the contact 4 is open as shown in FIG. 22. And also, the pallet-shaped contact a1 is closed and the pallet-shaped contact b1 is opened at a position where the contact 4 is closed. The other pallet-shaped contacts, which are the same as the above-mentioned pallet-shaped contacts, are disposed on the other two phases of the power line. Namely, pallet-shaped contacts a2 and b2 are provided on a second phase and pallet-shaped contacts a3 and b3 are provided on a third phase (shown in FIG. 22).

FIG. 22 shows conditions of the pallet-shaped contacts a1, a2, a3, b1, b2 and b3 when the contact 4 is opened. When the contact 4 is closed by operation of the driving mechanism 10, the pallet-shaped contact a1, which is disposed on the first phase, is closed and the pallet-shaped contact b1 is opened. The other contacts on the second and third phases are operated similarly. Therefore, when the three phases of the electric power lines are normally closed, current does not flow to a timer 30 and the contact 4 is maintained to be closed.

When the uneven closing of the contact takes place, for example in the second phase, the pallet-shaped contact b2 becomes kept closed. As a result, the electric current flows to the timer 30 and a contact 47 is closed after elapse of a predetermined time period. By such an operation, the electric curret flows to a trip coil 26, and the correction tripping is made to open the contact connected to the phase which has failed to make a normal closing.

In the above-mentioned conventional circuit breaker, occurrence of the uneven closing of the contacts is detected by the timer 30, and therefore the conventional circuit breaker has the disadvantages that the detection of the occurrence of the uneven closing of the contacts require a considerable time and also that the degree of breakdown advances during the detection. And, when the driving mechanism is broken down or is unmovable in breaking operation, it is impossible to improve the condition of the power line by open phase self-tripping to itself.

OBJECT AND SUMMARY OF THE INVENTION

A principal object of the present invention is to provide an improved circuit breaker which can detect the occurrence of trouble such as uneven closing of the phases quickly.

A circuit breaker in accordance with the present invention comprises:

- at least one contact for opening and closing a phase of an electric power line;
- an operation member for opening and closing the contact;
- driving means for driving the operation member at reception of a control signal;
- control signal detecting means for detecting whether the control signal is applied to the driving means or not;
- operation detecting means for detecting movement of the operation member;
- memory means for storing at least a regular control signal and normal moving process of the operation member;
- judging means for judging whether opening or closing operation of the contact is normally made or not, based on comparison among detected signals of the control signal detecting means and the operation detecting means and the regular control signal and memorized data of the normal moving process of the operation member stored in the memory means; and
- correcting operation means for correcting an abnormal state when the judgement means detects an abnormal state of one of the contact, the moving member and the driving means.

DESCRIPTION OF THE PREFERRED EMBODIMENT

Figure 1:
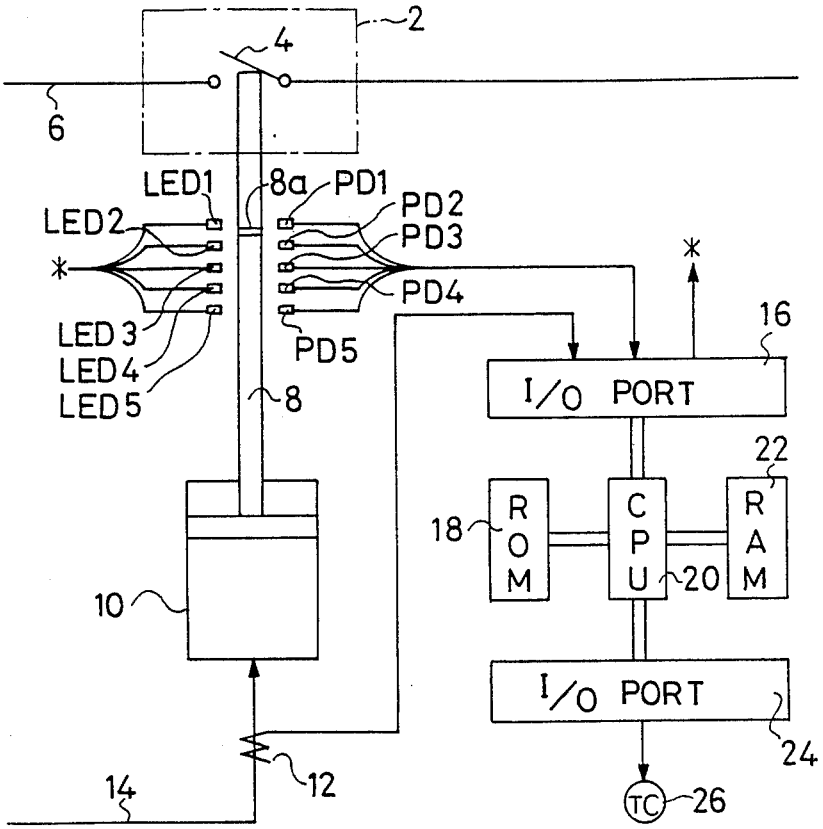
FIG. 1 is a block diagram showing a constitution of a preferred embodiment of a circuit breaker in accordance with the present invention.

A first preferred embodiment of a circuit breaker in accordance with the present invention is described in reference to FIG. 1.

In FIG. 1, a moving contact 4 is connected to an electric power line 6, which is schematically shown as single line, but really there are lines of three phases, and the moving contact 4 is driven by operation of a driving rod 8 of a driving mechanism 10. A through-hole 8*a* is disposed on the driving rod 8. Light emitting diodes array LED1, LED2, LED3, LED4 and LED5 and photodiodes array PD1, PD2, PD3, PD4 and PD5 are respectively disposed on both sides of the driving rod 8 and facing with each other. When the through-hole 8*a* passes between the couples of the light emitting diode and the photodiode LED1 and PD1, LED2 and PD2, LED3 and PD3, LED4 and PD4 and LED5 and PD5, the respective light emitted from the light emitting diodes is received by the corresponding photo-diodes. In this embodiment, the operation detecting device is constituted by the light emitting diodes LED1 and LED5, the through-hole 8*a* and the photo-diodes PD1 to PD5. Outputs of the photo-diodes PD1 to PD5 are given to I/O port 16 and also applied to CPU 20.

On the other hand, electric current for controlling the operation of the driving mechanism 10 is detected by a current sensor 12 which serves as a control signal detecting device. Output of the current sensor 12 is also given to the I/O port 16.

Figure 7A:
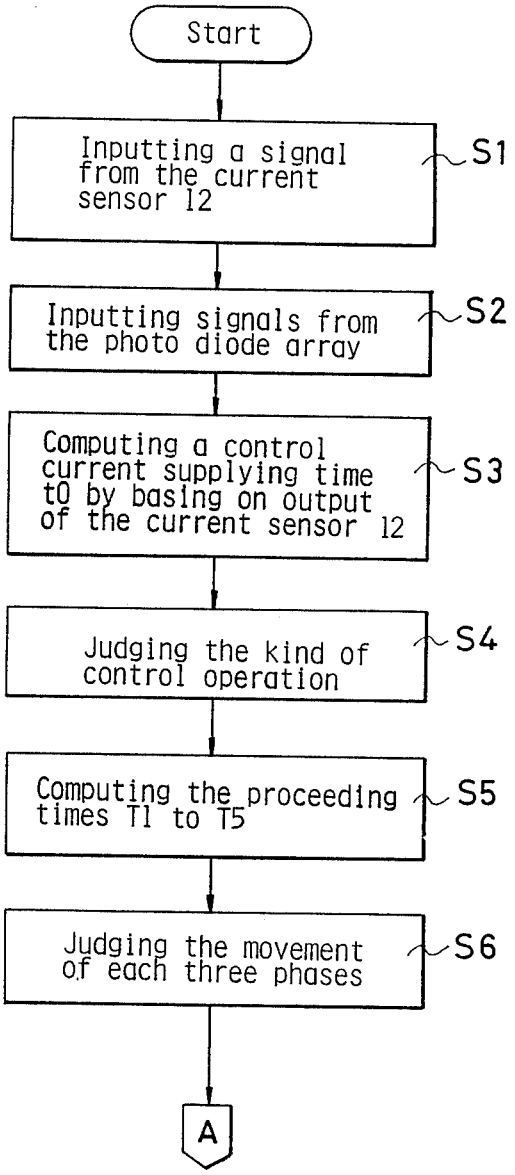
FIG. 7(A:) and FIG. 7(B) are flow charts showing a program stored in ROM 18 in FIG. 1.
Figure 7B:
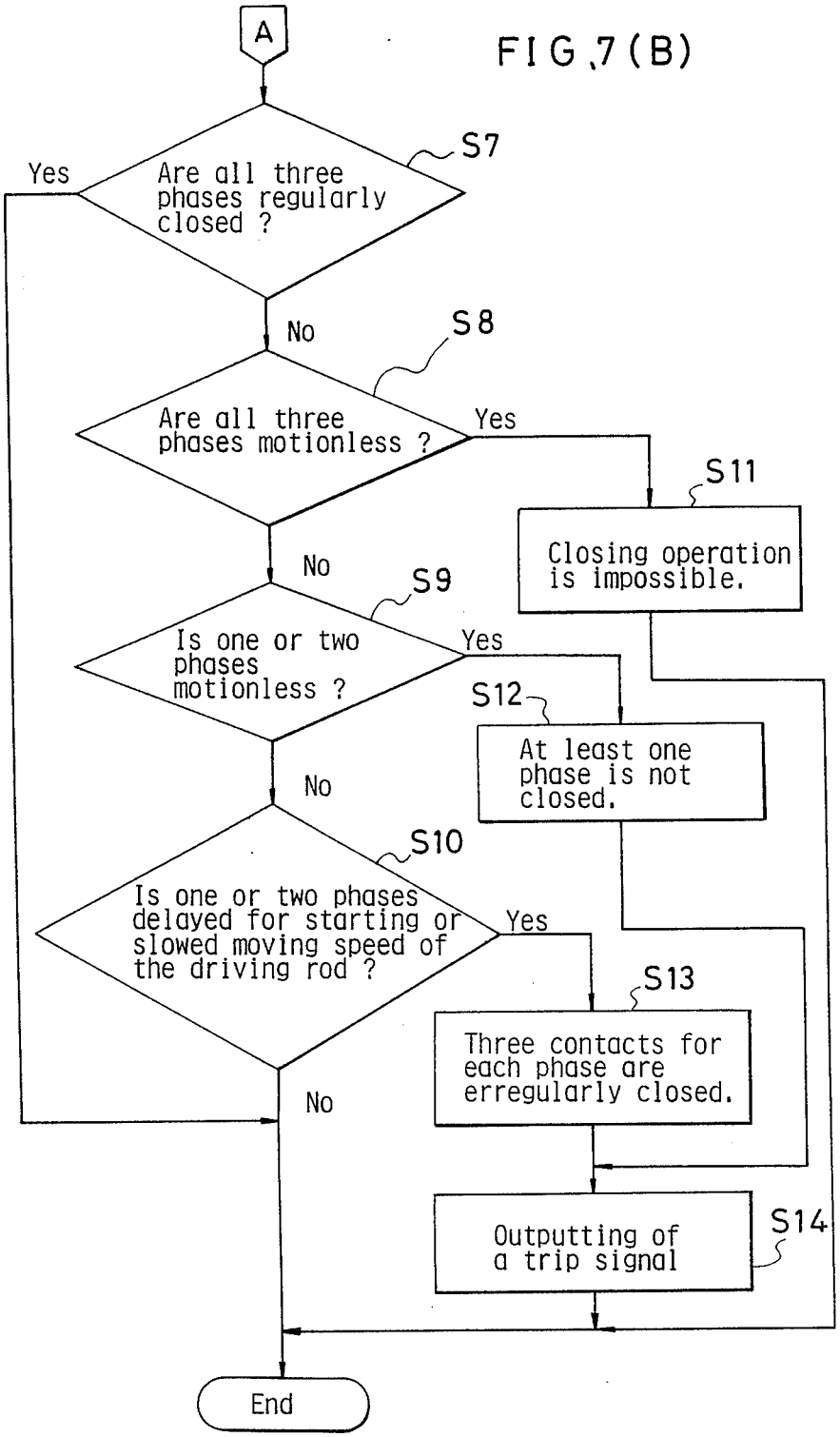

The CPU 20 controls every elements in compliance with a program stored in a ROM 18. FIG. 7(A) and FIG. 7(B) shows a flow chart of a program stored in the ROM 18.

First, the CPU 20 controls the I/O port 16 and stored the output from the current sensor 12 in a RAM 22 (step S1). Second, the CPU 20 stores the outputs from the photo-diodes PD1 to PD5 in the RAM 22 in the same manner (step S2).

Third, the CPU 20 computes a control current supplying time t0 based on the output from the current sensor 12 in step S3. The CPU 20 also computes proceeding times T1, T2, T3, T4 and T5 based on the outputs of the photo-diodes PD1 to PD5 (step S5).

Hereupon, the proceedinhg time T1 is a time period from a time when a closing signal is applied to the driving mechanism 10 at a condition that the contacts are open for a time when the through-hole 8*a* of the driving rod 8 passes the photo-diode PD1. Also, the proceeding time T2 is a time period from the time when the closing signal is applied to the driving mechanism 10 through a time when through-hole 8*a* of the driving rod 8 passes the photo-diode PD2. Still other proceeding times T3, T4 and T5 are defined similarly. The above-mentioned inputting of the control signals and computing (step S1 to S5) is executed for respective three phases.

Fourth, the CPU 20 judges whether the driving mechanism is regularly operated or not on the computed data in the above-mentioned steps (step S6). The judgment of the operation of the driving mechanism is now described with reference to FIG. 2 to FIG. 6.

Figure 2:
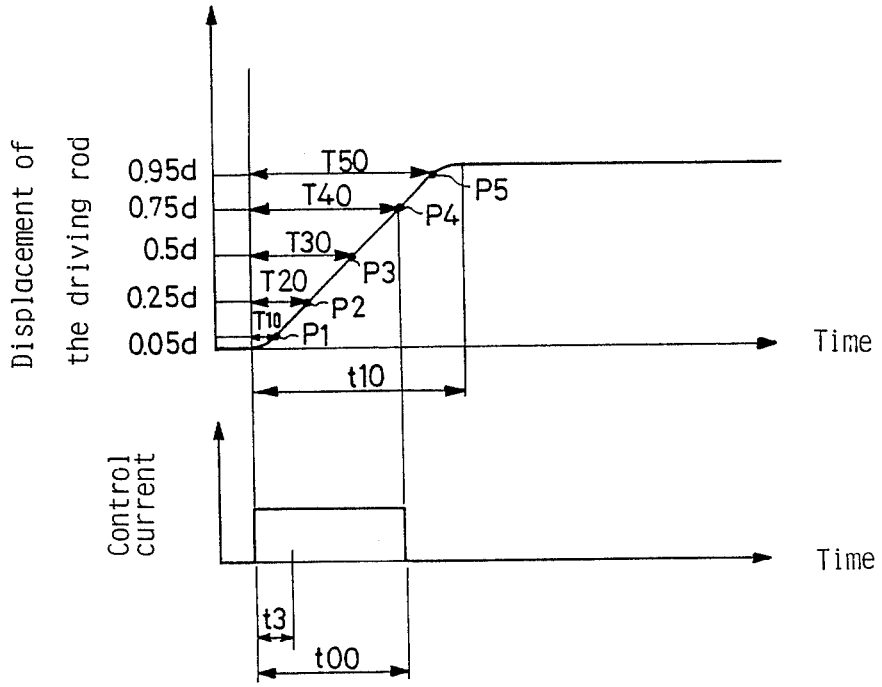
FIG. 2 is a time chart showing normal closing operation of a driving rod 8 in FIG. 1.

FIG. 2 shows the relation between the movement of the driving rod 8 and the control current when the closing operation is regularly executed. In this embodiment, the photo-diodes PD1, PD2, PD3, PD4 and PD5 are disposed on positions P1, P2, P3, P4 and P5 which correspond to 5%, 25%, 50%, 75% and 95% of full stroke of the driving rod 8 from opening position to closing position, respectively. Reference proceeding times T10, T20, T30, T40 and T50 in regular operation and the regular closing time t10 are previously stored in the ROM 18. A normal current supplying time t00 of the control current and a required minimum time t3 for supplying current (which is a minimum time of supplying time of the control current required for making the driving rod 8 move) are previously stored in the ROM 18.

Figure 3:
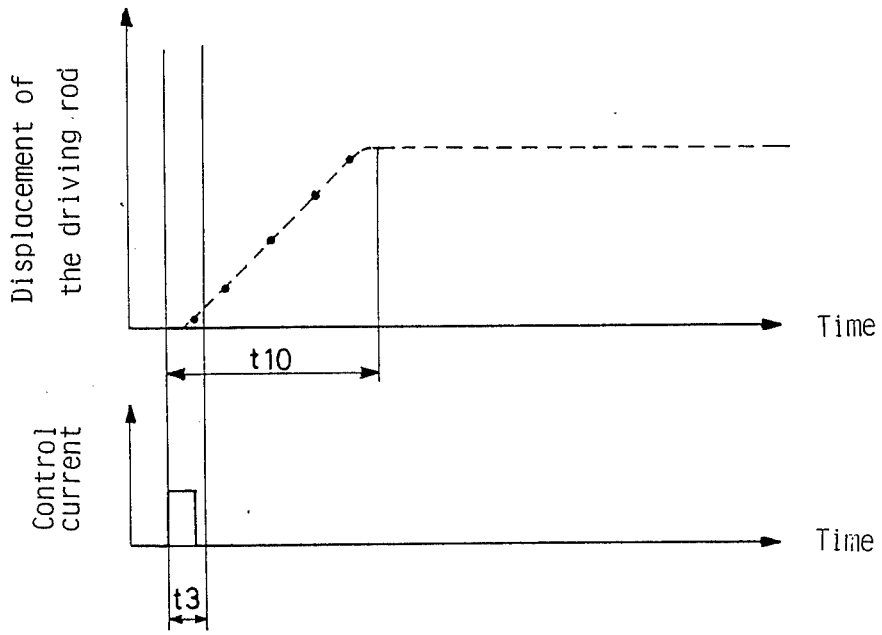
FIG. 3 is a time chart illustrating the relationship between the driving rod and the control current during an abnormal closing operation of the driving rod 8 in FIG. 1 when the current supplying time is short.

FIG. 3 shows the relation between the movement of the driving rod 8 and the control current when a current supplying time is shorter than the necessary minimum time t3 for current supplying. When there is no output issued from the photo-diode PD1 after passing the time t10 (which is the regular closing time), the CPU 20 detects that the driving rod 8 is not driven. In this embodiment, the irregular operation of the driving rod 8 is judged after passing the regular closing time t10; but it is possible to arrange that the irregular operation is judged after passing of a different time period, for example, $\frac{1}{2}\cdot$t10.

Figure 4:
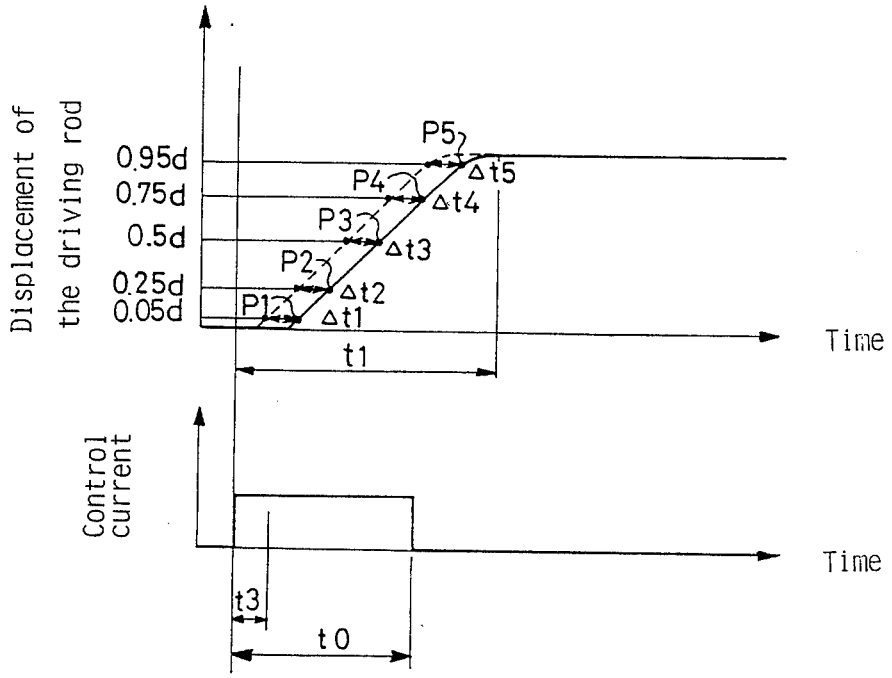
FIG. 4 is a time chart illustrating the relationship between the driving rod and the control current during an abnormal closing operation of the driving rod 8 in FIG. 1 when the start of the movement of the driving rod is delayed.

FIG. 4 shows the relation between the movement of the driving rod 8 and the control current when the start of the movement of the driving rod 8 is delayed. In this case, the proceeding times T1, T2, T3, T4 and T5 are delayed by delay times $\Delta$t1, $\Delta$t2, $\Delta$t3, $\Delta$t4 and $\Delta$t5 in comparison with those in normal case. When the delay times $\Delta$t1 to $\Delta$t5 are substantially equal and a closing time t1 is within a time twice as long as the regular closing time t10, the CPU 20 judges that the start of the movement of the driving rod 8 is delayed.

Figure 5:
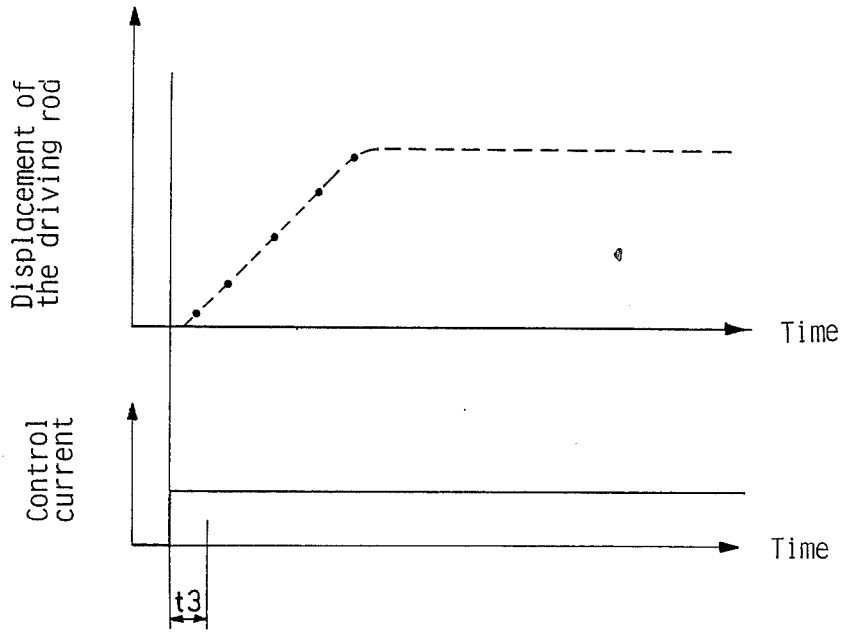
FIG. 5 is a time chart illustrating the relationship between the driving rod and the control current during an abnormal closing operation of the driving rod 8 in FIG. 1 when the driving rod cannot move in spite of an adequate control current.

FIG. 5 shows time charts of the movement of the driving rod 8 and the control current when the driving rod 8 cannot move in spite of control current supply. When the current supplying time t0 is longer than the minimum time t3 of current supplying and the proceeding times T1 to T5 are over a time which is twice as long as normal proceeding time T10, the CPU 20 judges that the driving rod 8 is not moved.

Figure 6:
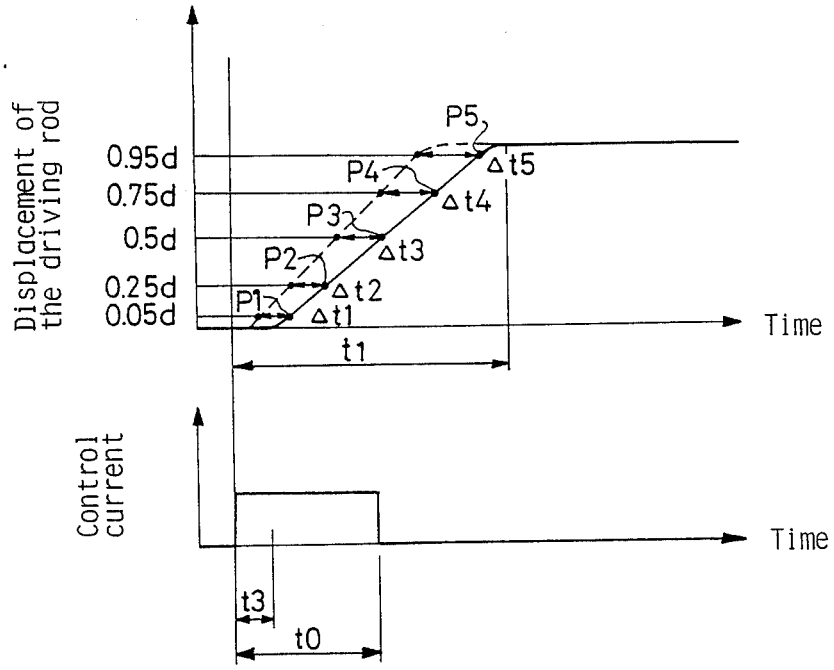
FIG. 6 is a time chart illustrating the relationship between the driving rod and the control current during an abnormal closing operation of the driving rod 8 in FIG. 1 when the driving rod moves abnormally slowly.

FIG. 6 shows the time charts of the movement of the driving rod 8 and the control current when the moving speed of the driving rod 8 is slower than a predetermined normal value due to any reason. When the current supplying time t0 is longer than necessary minimum current supplying time t3 and the delay times Δt1 to Δt5 are gradually enlarged, for example, (T3−T2)/(T30−T20)>2, the CPU 20 judges that the moving speed of the driving rod 8 is slower.

The judgments of the CPU 20 are shown in the following Table:

TABLE 1

Judgement for motions of each phases of the power line

| conditions of judgement | judged results: case of regular motion | case of no motion (1) | case of delayed start | case of no motion (2) | case of slowed speed |
|---|---|---|---|---|---|
| $t0 \geqq t3$ | | | | | |
| $t0 \leqq t3$ | | | | | |
| $Ti \cong TiO$ $(i = 1 \sim 5)$ | | | | | |
| $T1 > t10$ | | | | | |
| $2\,TiO > Ti > TiO$ $(i = 1 \sim 5)$ | | | | | |
| $\Delta ti \approx$ constant $(i = 1 \sim 5)$ | | | | | |
| $Ti > 2\,TiO$ $(i = 1 \sim 5)$ | | | | | |
| $\frac{T3 - T2}{T30 - T20} > 2$ | | | | | |
| closing operation | | | | | |

Marks shows the cases of judgments designated in the top columns.

In step S6, the CPU 20 executes the above-mentioned judgments for each phases. After that, in step S7, the CPU 20 judges whether all three phases are normally closed or not. When the three phases are normally closed, the CPU 20 finishes its operation. When the three phases are abnormally closed, the CPU 20 further proceed its operation and the impossibility of closing, open phase or closing of inuniformity in steps S8, S9 and S10. When the CPU 20 judges that the open phase or nonuniform closing occurs, the CPU 20 issues a trip signal to the I/O port 24 in step S14 and energizes a trip coil 26.

Another preferred embodiment (second embodiment) of a circuit breaker in accordance with the present invention is described with reference to FIG. 8.

Figure 8:
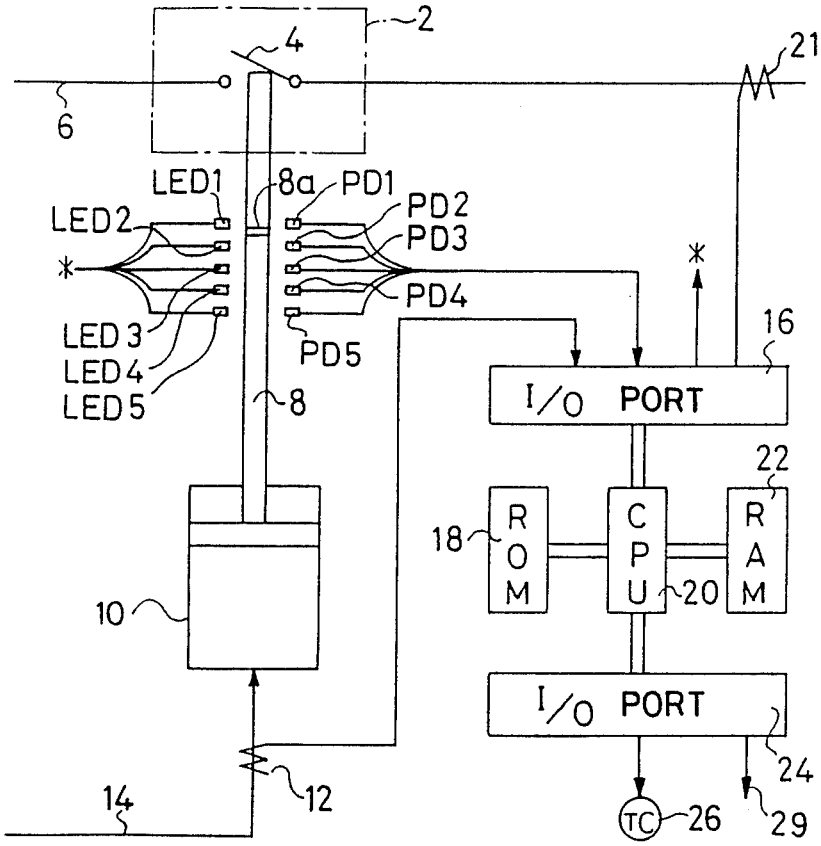
FIG. 8 is a block diagram showing a constitution of another preferre*d embodiment of a circuit breaker in accordance with the present invention.

The second embodiment shown in FIG. 8 further comprises a current sensor 21 for detecting current value of the main power line 6 besides the first embodiment shown in FIG. 1. Output of the current sensor 21 is issued to the I/O port 16, and the output of the current sensor 21 is stored in the RAM 22. The rest of the structure of the second embodiment is the same as that of the first embodiment. Therefore, a detailed description of the same configuration is omitted.

FIG. 13(A), FIG. 13(B), FIG. 13(C) and FIG. 13(D) show a flow chart of a program stored in the ROM 18.

First, the CPU 20 controls the I/O port 16 and stores the output from the current sensor 12 in the RAM 22 (step S1). Second, the CPU 20 stores the outputs from the photo-diodes PD1 to PD5 (step S2). Third, current sensor 21 stores the same in the RAM 22 in the similar manner (step S3). Thereupon, measurements in the above-mentioned steps S1, S2 and S3 are preferably repeated with regular intervals.

Fourth, the CPU 20 computes a control current supplying time t0 based on the output from the current sensor 12 (step S4). Fifth, the CPU 20 judges the type of control operation (step S5). Sixth, the CPU 20 computes proceeding times T1, T2, T3, T4 and T5 basing on the outputs from the photo-diodes PD1, PD2, PD3, PD4 and PD5 (step S6). Seventh, the CPU 20 computes a current supplying time t00′ of the main power line 6 based on the output from the current sensor 21 (step S7).

The CPU 20 judges whether the operation of the closing or opening of the contact 4 is normal or not. The judging processes for closing operation or opening operation of the contact 4 are different from each other, in accordance with the result of the judgment in step S5 (step S8).

Figure 9:
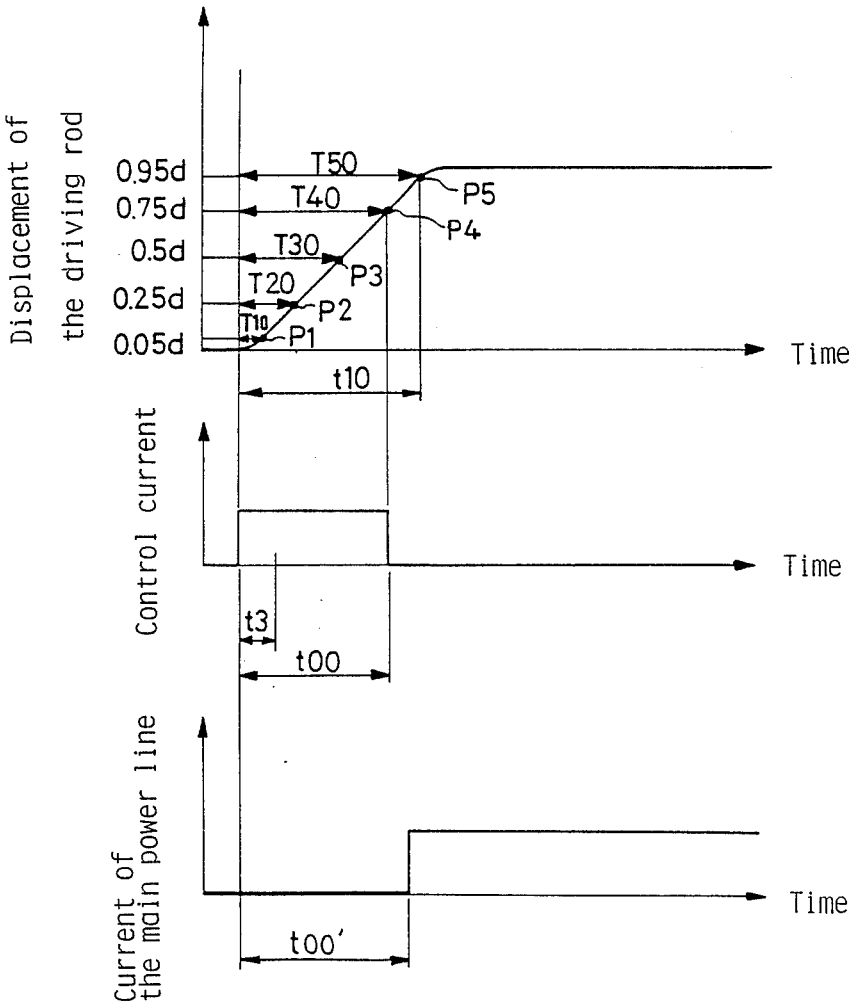
FIG. 9 is a time chart showing normal closing operation of a driving rod 8 in FIG. 8.
Figure 13:
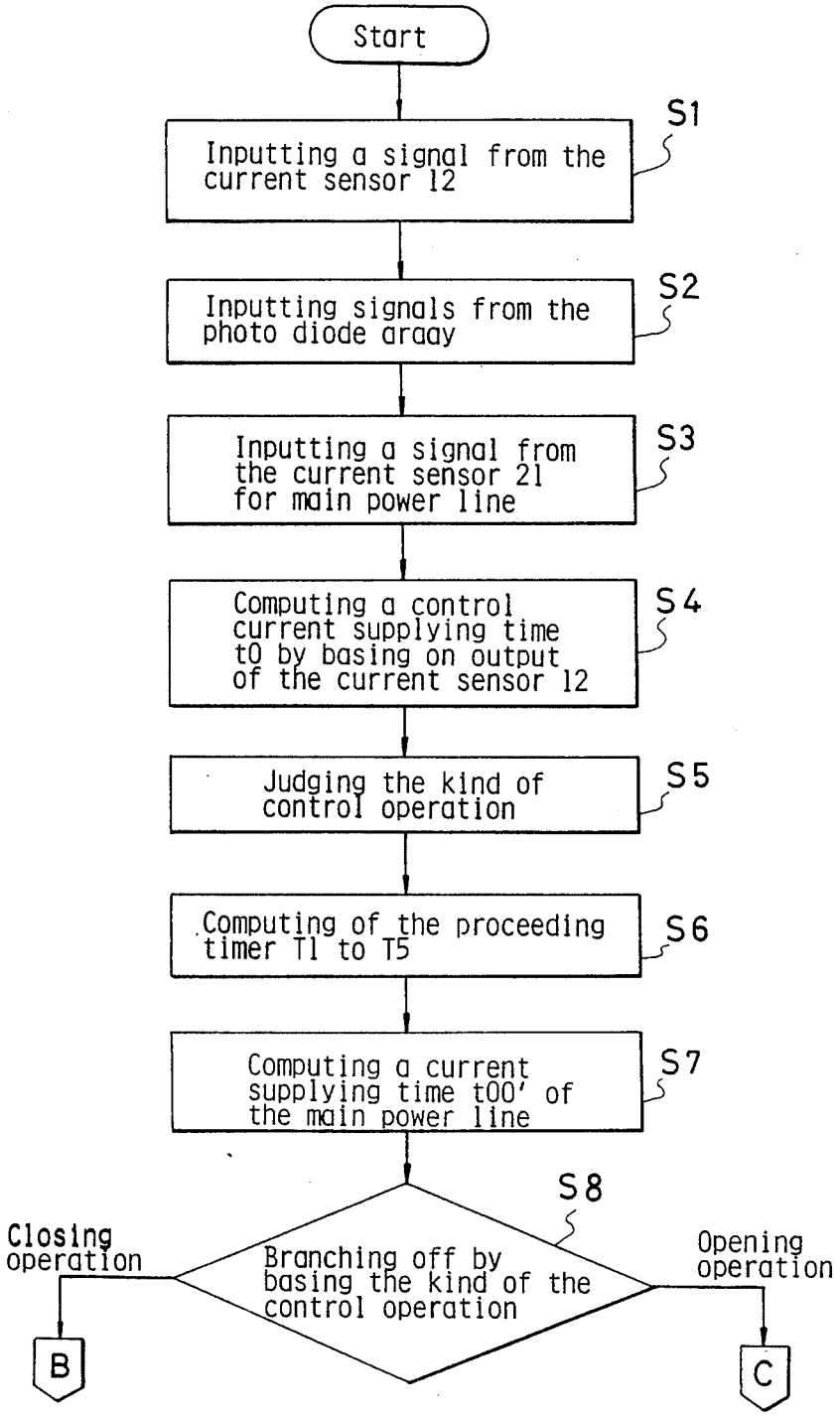
FIG. 13(A), FIG. 13(B), FIG. 13(C), FIG. 13(D) and FIG. 13(E) are flow charts showing a program stored in ROM 18 in FIG. 8.
Figure 13:
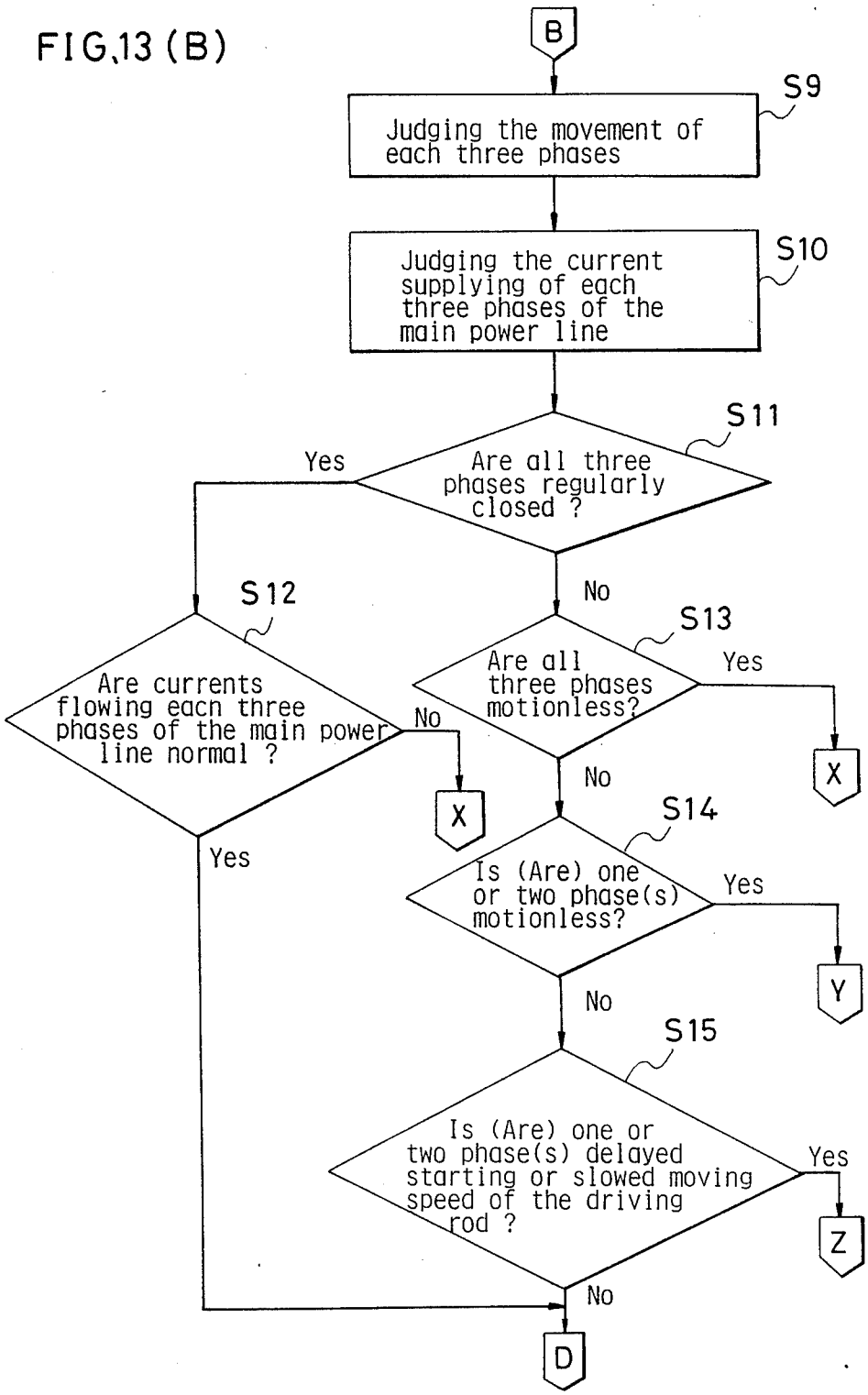

A flow chart for the closing operation of the contact 4 is shown in FIG. 13(B). For judging in total view point, the CPU 20 judges whether the motions of the driving rod 8 for each phases are normal or not (step S4). After judging the operation of the driving rod 8 in the above-mentioned step S9, the CPU 20 judges whether the current flow of the main power line 6 for each phases are normal or not, in step S10. When the contact 4 is normally closed, the electric current flows on the main power line 6 after elapsing the time t00′ as shown in FIG. 9. Accordingly, when the electric current does not flow in the main power line 6 after elapsing of time period t10, the CPU 20 judges that the electric current of the main power line 6 is abnormal. Such judgment is done for every phase.

After judging whether the movements of the driving rod for all phases are normal or not in step S9, and after judging whether the current flows in the main power line 6 for all phases are normal or not in step S10, a total judgment is done by following the steps below the step S11.

Figure 11:
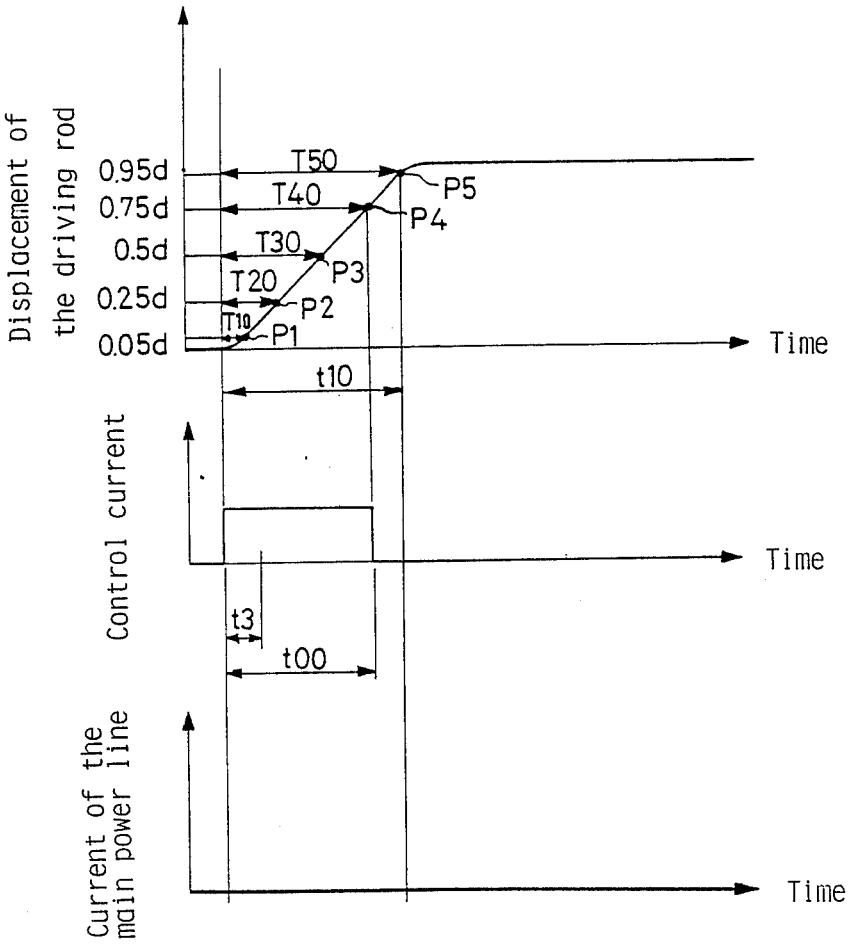
FIG. 11 is a time chart showing abnormal closing operation of the driving rod 8 in FIG. 8.

When the movements of the driving rod 8 for all three phases are normal in step S11, the CPU 20 proceeds to step S12. In the step S12, when the current flows of the main power line 6 for each of the three phases are normal, the CPU 20 concludes its operation. On the other hand, when at least one current flow of the main power line 6 for three phases is abnormal as shown in FIG. 11, the CPU 20 judges that the closing operation of the contact 4 is impossible. The CPU 20 then outputs a warning signal through the I/O port 24, which then outputs an opening signal to a spare protection system of the breaker.

As a result, this embodiment can detect a problem which hitherto could not be detected by circuit breaker for detecting movement of the driving rod 8 only.

For example, the circuit breaker of the embodiment shown in FIG. 8 can judge that the contact 4 can not be closed, when the current does not flow on the main power line 6 after the lapse of a time periods t10 under normal movement of the driving rod 8, due to any cause (as shown in FIG. 11).

When the driving rod 8 for even one phase fails to move in step S11, the CPU 20 proceeds to step S13. Hereupon, when the driving rod 8 for all three phases do not move, the CPU 20 judges that the closing of the contact 4 is impossible, and it proceeds to steps S19 and S21. Where there is at least one phase to be moved, the CPU 20 proceeds to step S14.

In step S14, when one or two phases can not be moved, the CPU 20 proceeds to step S16. In step S16, the CPU 20 judges whether the current flow of the remaining phases (which normally has operated) is normal or not. Hereupon, when the current flow of the remaining phase is abnormal, the CPU 20 judges that the closing operation of the contact 4 is impossible, and it proceeds to the steps S19 and S21. On the other hand, when the current flow of the rest phase is normal, the CPU 20 judges that the open phase occurred (step S17) and issues a trip signal for correcting occurrence of the missing of phase in step S22. This trip signal is applied to the tripping coil 26 by intermediating the I/O port 24.

In the step S14, iin cases other than the case where the driving rod 8 of one or two phase does not move, the CPU 20 proceeds to step S15. In step S15, when the CPU 20 judges that the driving rod 8 of the one or two phase is of delayed starting or the driving speed of the driving rod 8 is insufficient, the CPU 20 proceeds to the step S18. In the step S18, the CPU 20 judges whether the current flow on the rest phase of the main power line 6 (which is the phase driving rod 8 is normally moved) is normal or not.

Hereupon, when the current in either one of said other phasees is abnormal, the CPU 20 judges that the closing operation of the contact 4 is impossible and proceeds to steps S19 and S21. And when the current on the phase is normal, the CPU 20 judges occurrence of incomplete closing of the contact (step S20) and issues a trip signal for correcting the missing of the phase in step S22.

Figure 13C:
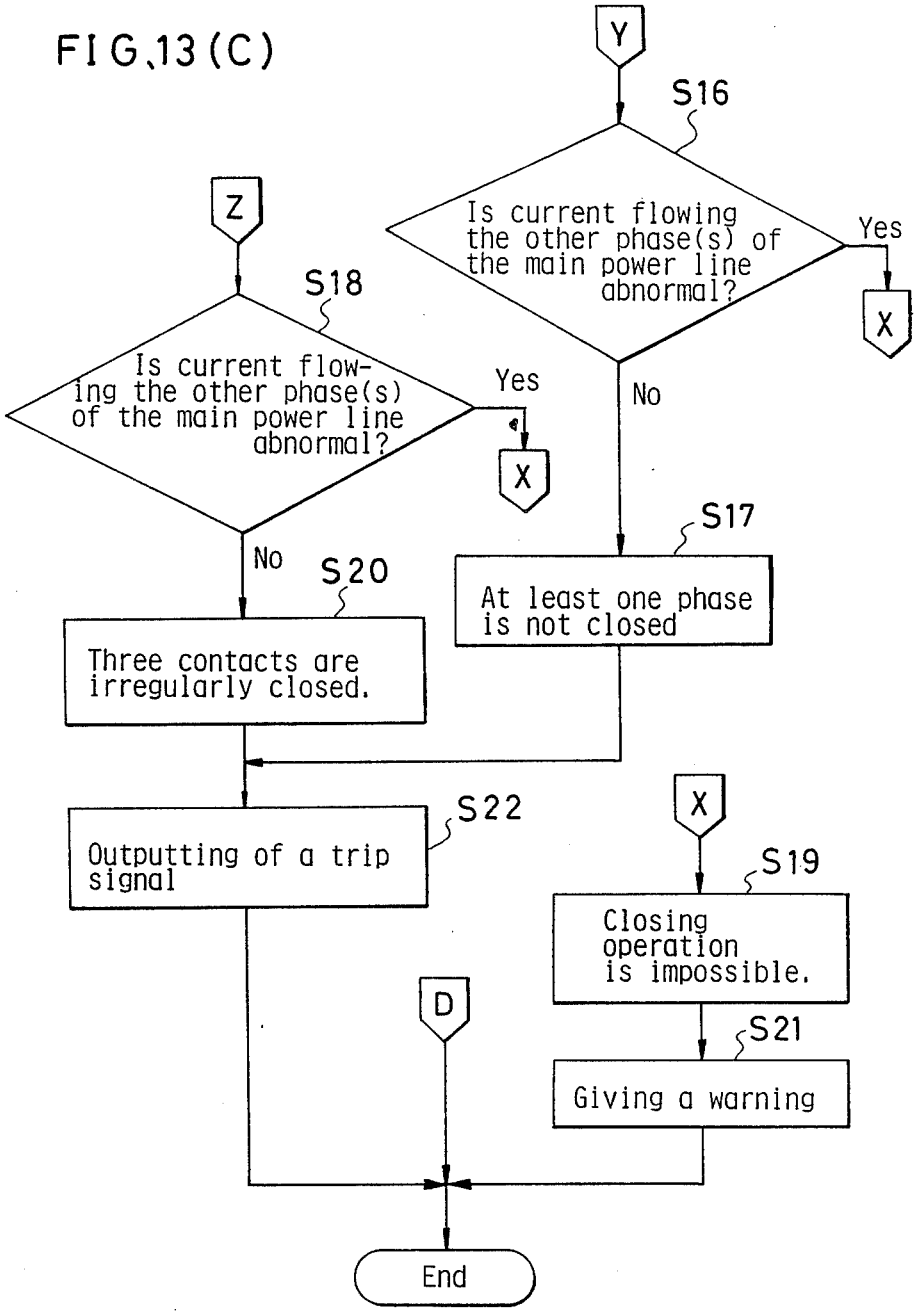
Figure 13D:
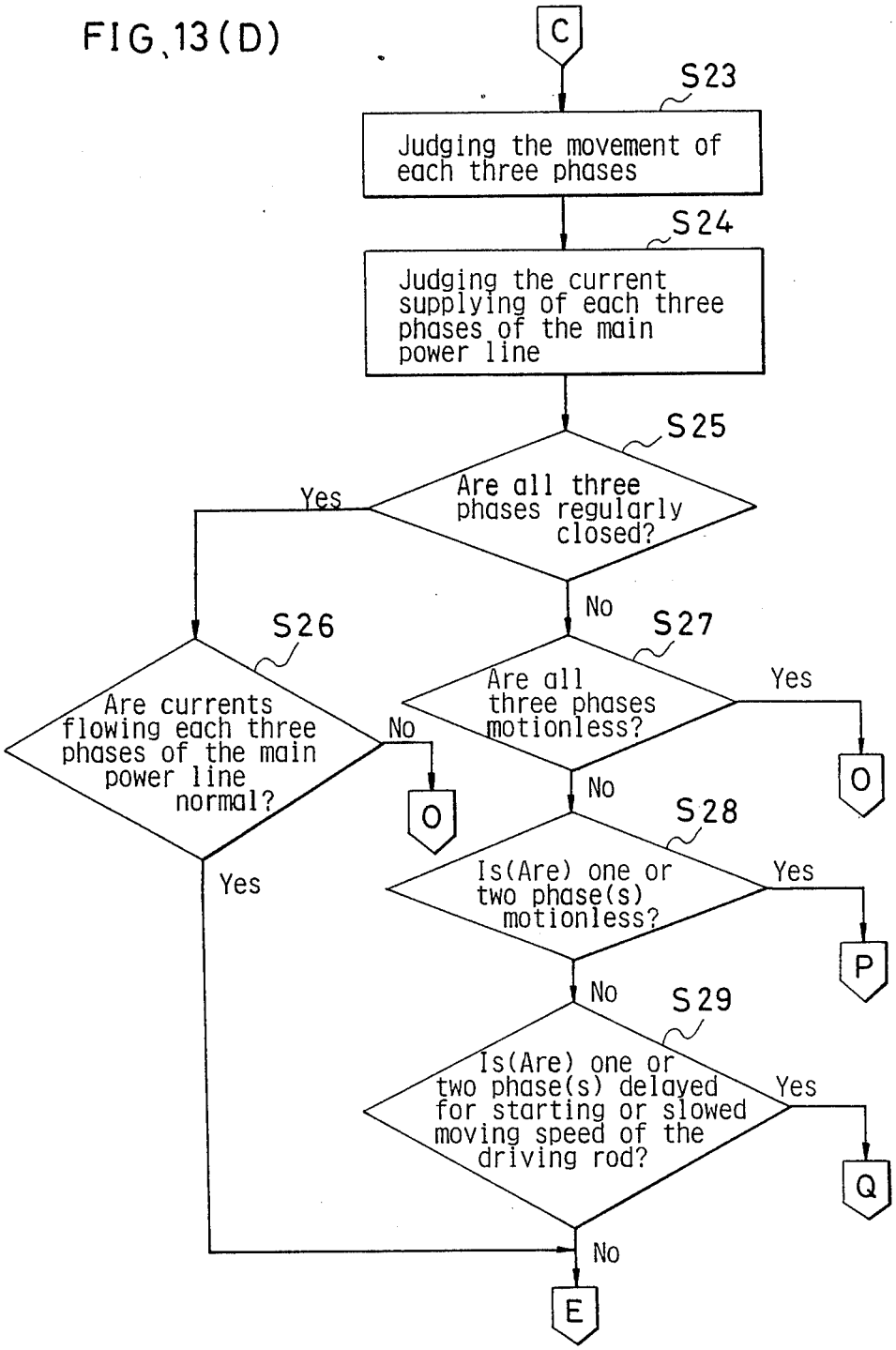
Figure 13E:
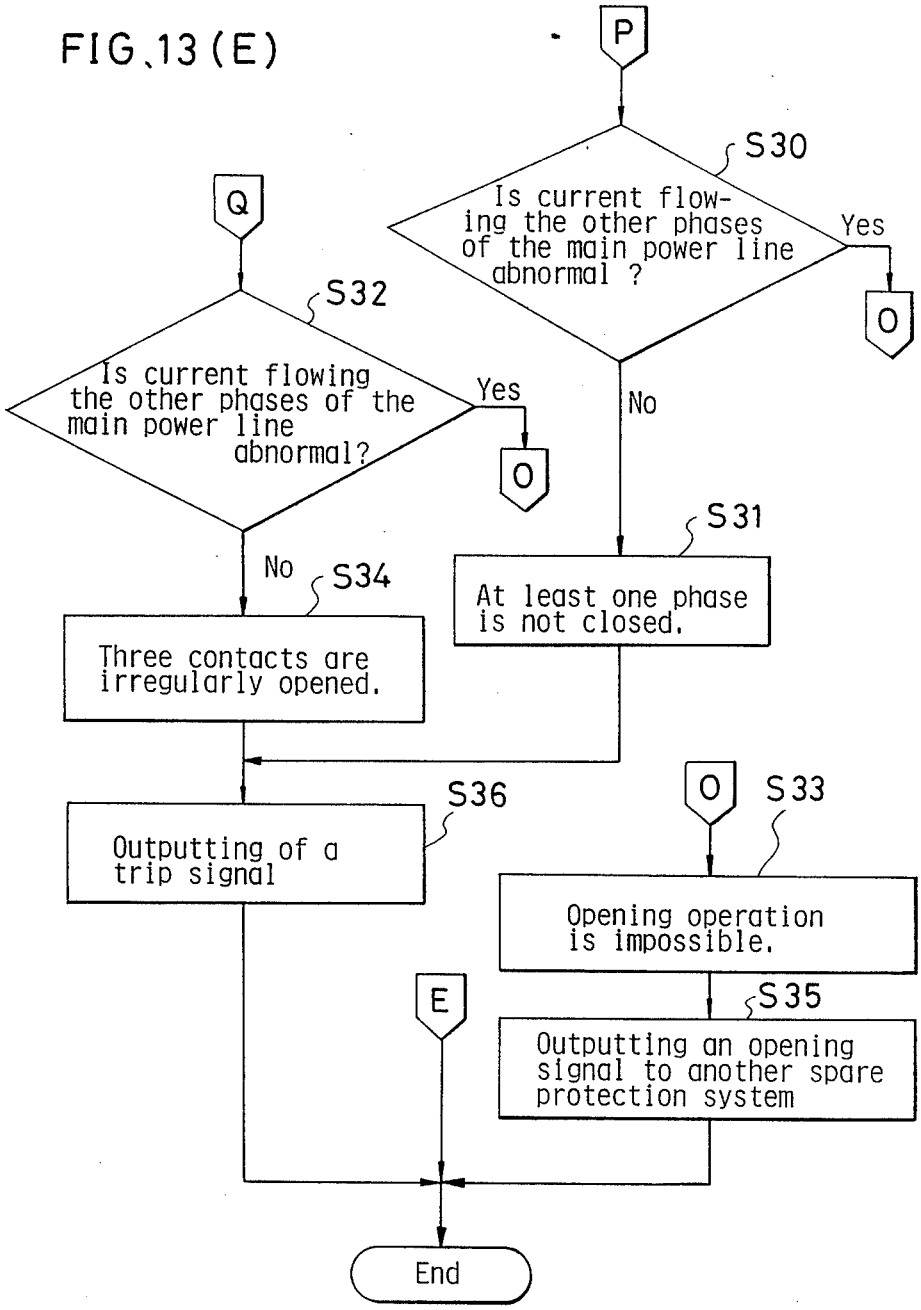

The above-mentioned steps are described for a closing operation of the contact 4. The description for opening operation of the contact 4 is substantially the same and the flow chart thereof is shown in FIG. 13(C). For judging synthetically, the CPU 20 judges whether the operations of the driving rod 8 for all the phases are normal or not (step 23).

Figure 10:
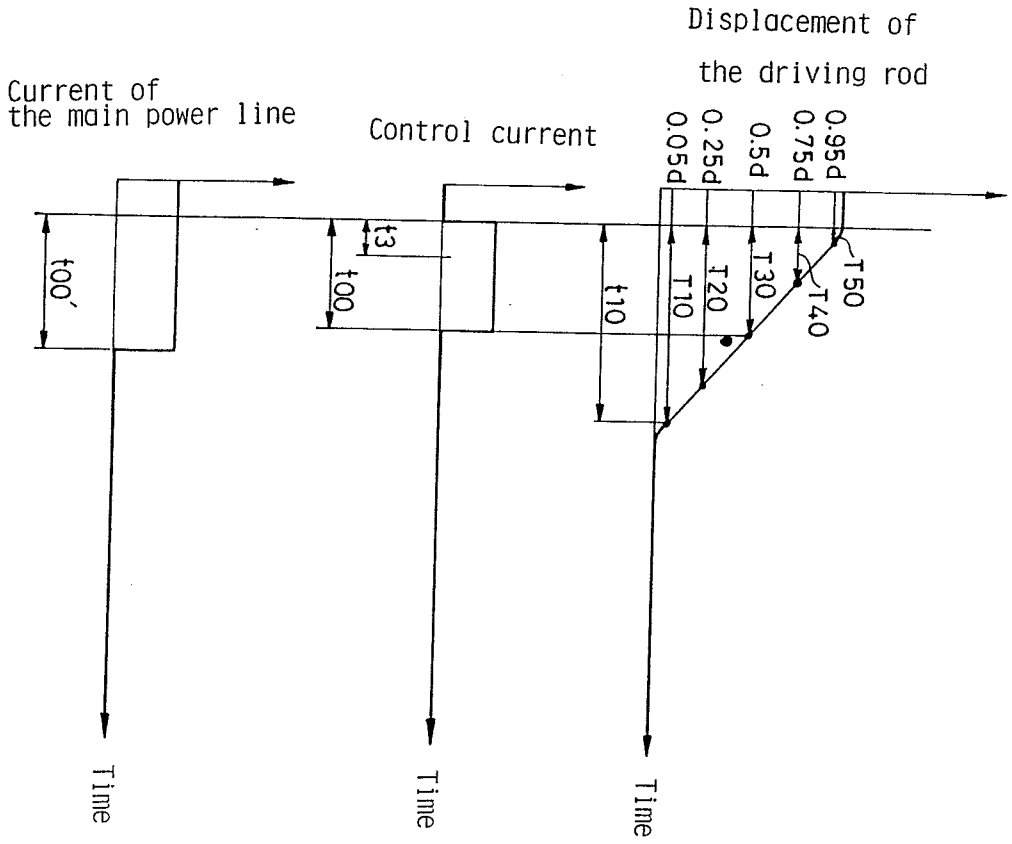
FIG. 10 is a time chart showing normal opening operation of the driving rod 8 in FIG. 8.
Figure 12:
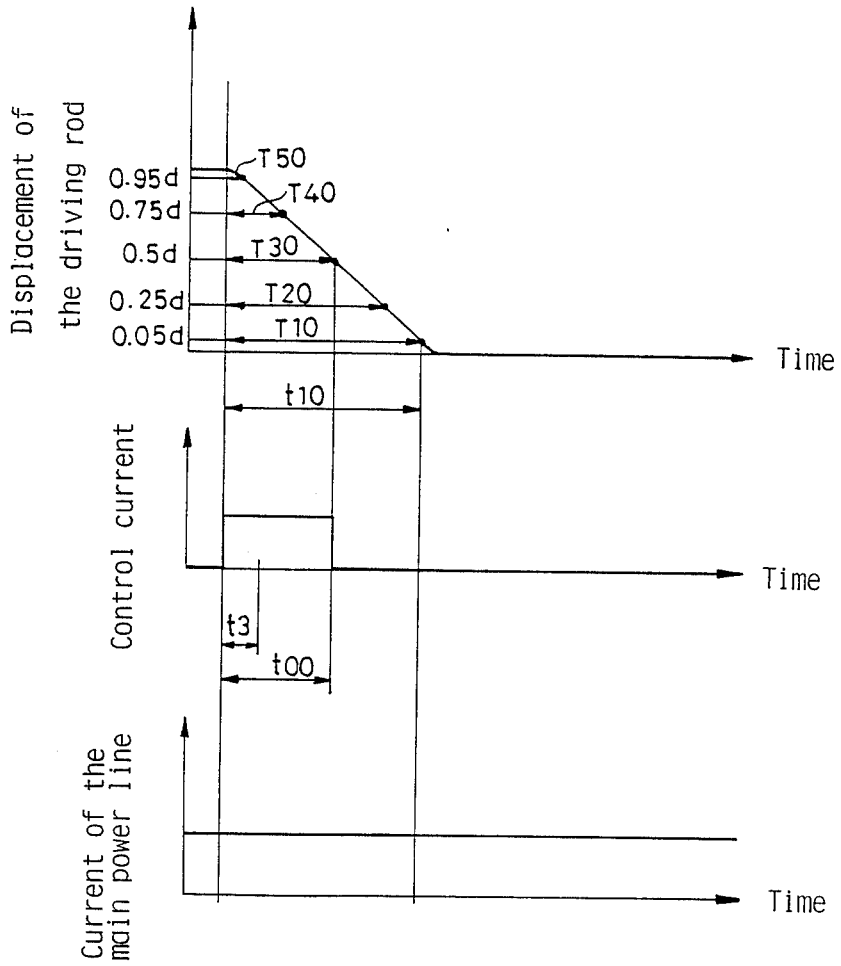
FIG. 12 is a time chart showing abnormal opening operation of the driving rod 8 in FIG. 8.

FIG. 10 comprises time charts showing a relation between the moving stroke of the driving rod 8 and the control current in normal operation of opening of the contact 4. The proceeding items T10, T20, T30, T40 and T50 and the normal opening time t10 in the normal opening operation are previously stored in the ROM 18. The reaching of judgments, of the CPU 20, shown in steps S23 to S36 are substantially the same as illustrated in FIG. 13(B), and hence, a detailed description thereof is omitted. The case when the driving rod 8 is normally moved but the current on the main power line 6 is not broken is shown in FIG. 12, and the CPU 20 can judge the same as described.

Still another preferred embodiment (third embodiment) of a circuit breaker in accordance with the present invention is described with reference to FIG. 14.

Figure 14:
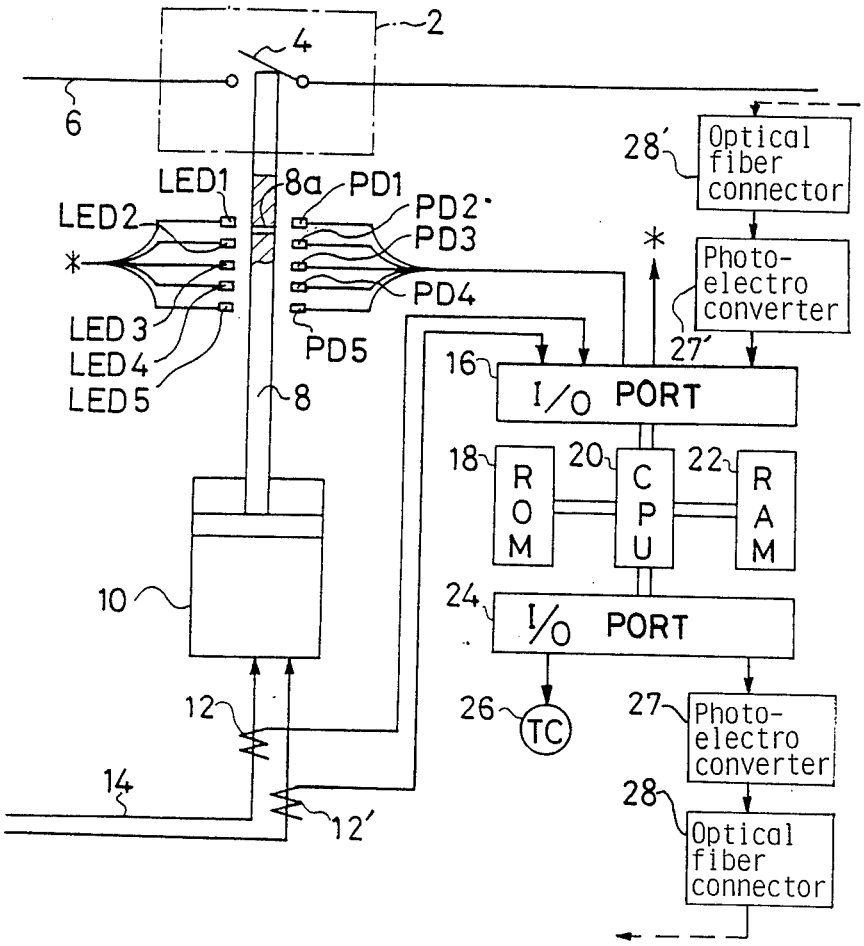
FIG. 14 is a block diagram showing a constitution of still other preferred embodiment of a circuit breaker in accordance with the present invention.

In FIG. 14, a moving contact 4 is connected to an electric power line 6, which is schematically shown as a single line but really has three phases, and the moving contact 4 is driven by operation of a driving rod 8 of a driving mechanism 10. A through-hole 8*a* is disposed on the driving rod 8. Light emitting diodes array LED1, LED2, LED3, LED4 and LED5 and photo-diodes array PD1, PD2, PD3, PD4 and PD5 are respectively disposed on opposite sides of the driving rod 8 and face each other. When the through-hole 8*a* passes between the pairs of the light emitting diode and the photo-diode LED1 and PD1, LED2 and PD2, LED3 and PD3, LED4 and PD4 and LED5 and PD5, the light emitted from the light emitting diodes is received by the corresponding photo-diodes. In this embodiment, operation detecting means is constituted by the light emitting diodes LED1 to LED5, the through-hole 8*a* and the photo-diodes PD1 to PD5. Outputs of the photo-diodes PD1 to PD5 are issued to I/O port 16 and also are applied to CPU 20.

On the other hand, electric current for controlling the operation of the driving mechanism 10 is detected by current sensors 12 and 12' which serves as a control signal detecting means. An output of the current sensors 12 and 12' are also issued to the I/O port 16. As a judgement means, the CPU 20 judges whether the driving rod 8 is normally moved or not, whether open phase occurs or not and whether the moving speed of the driving rod 8 is delayed or not. In these cases, the CPU 20 serves as control means for issuing a tripping signal to an I/O port 24.

The I/O ports 16 and 24 are respectively connected to photo-electro converters 27 and 27'. And optical-fiber connectors 28 and 28' are respectively connected to the photo-electro converters 27 and 27'.

The I/O port 24 issues the tripping signal to a spare protection system by passing through an optical-fiber (not shown in the figure). The I/O port 16 receives 9 tripping signals from another circuit breaker (not shown in the figure), when the circuit breaker shown in FIG. 14 is used to serve as a spare protection system for another circuit breaker. The current sensor 12 detects a control current for closing operation of the contact 4 and the current sensor 12' detects another control current for opening operation of the contact 4.

Figure 20A:
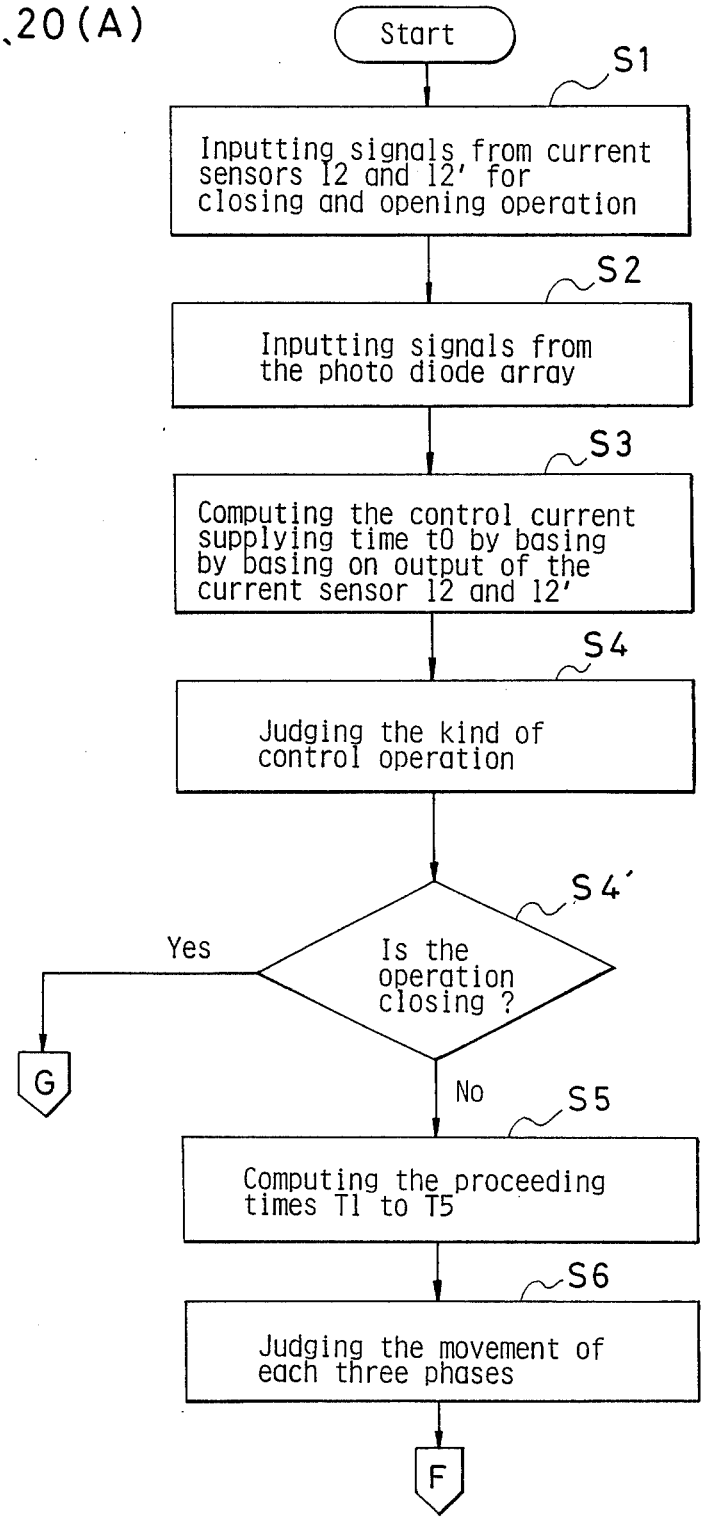
FIG. 20(A), FIG. 20(B) and FIG. 20(C) are flow charts showing a program stored in ROM 18 in FIG. 14.
Figure 20:
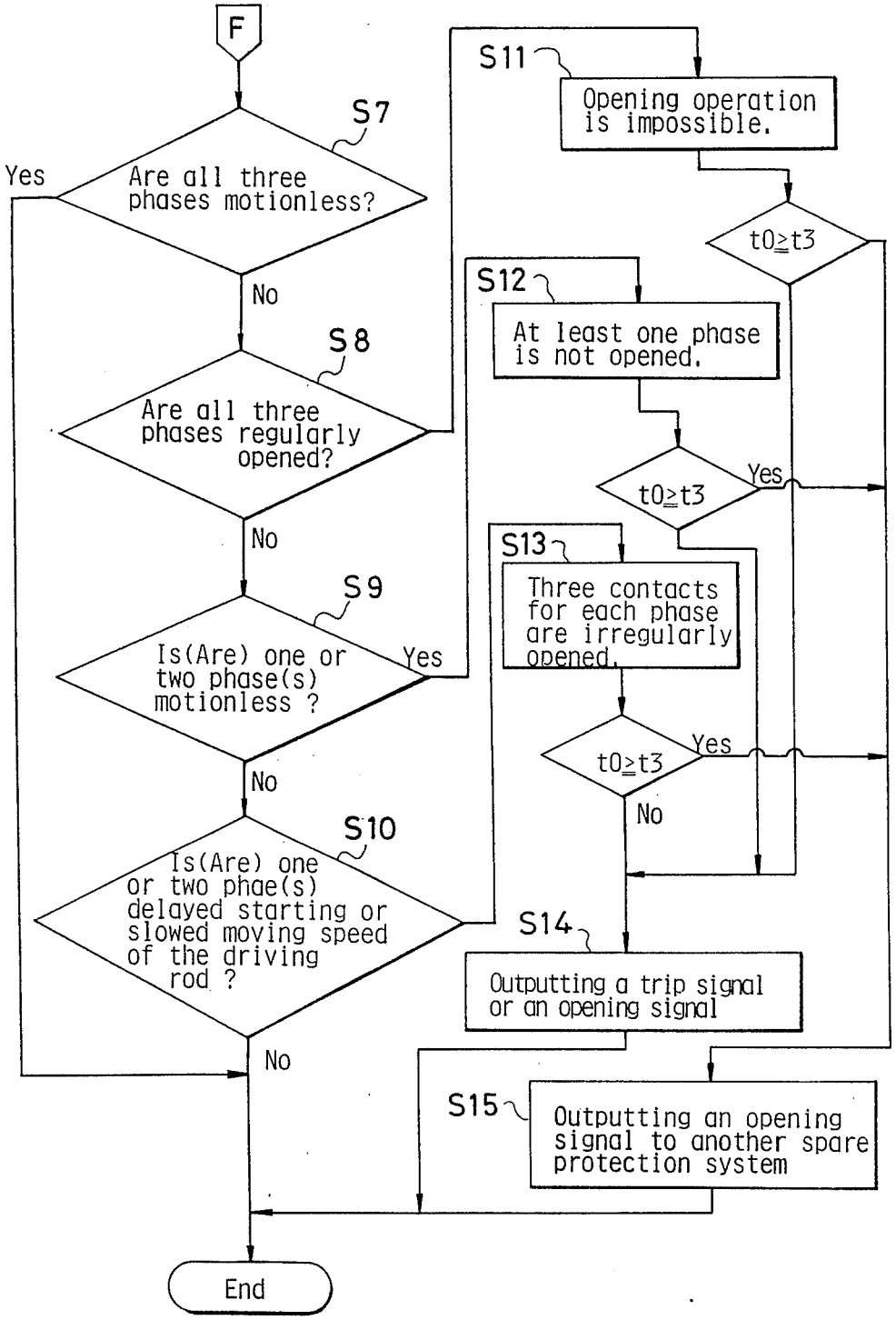
Figure 20C:
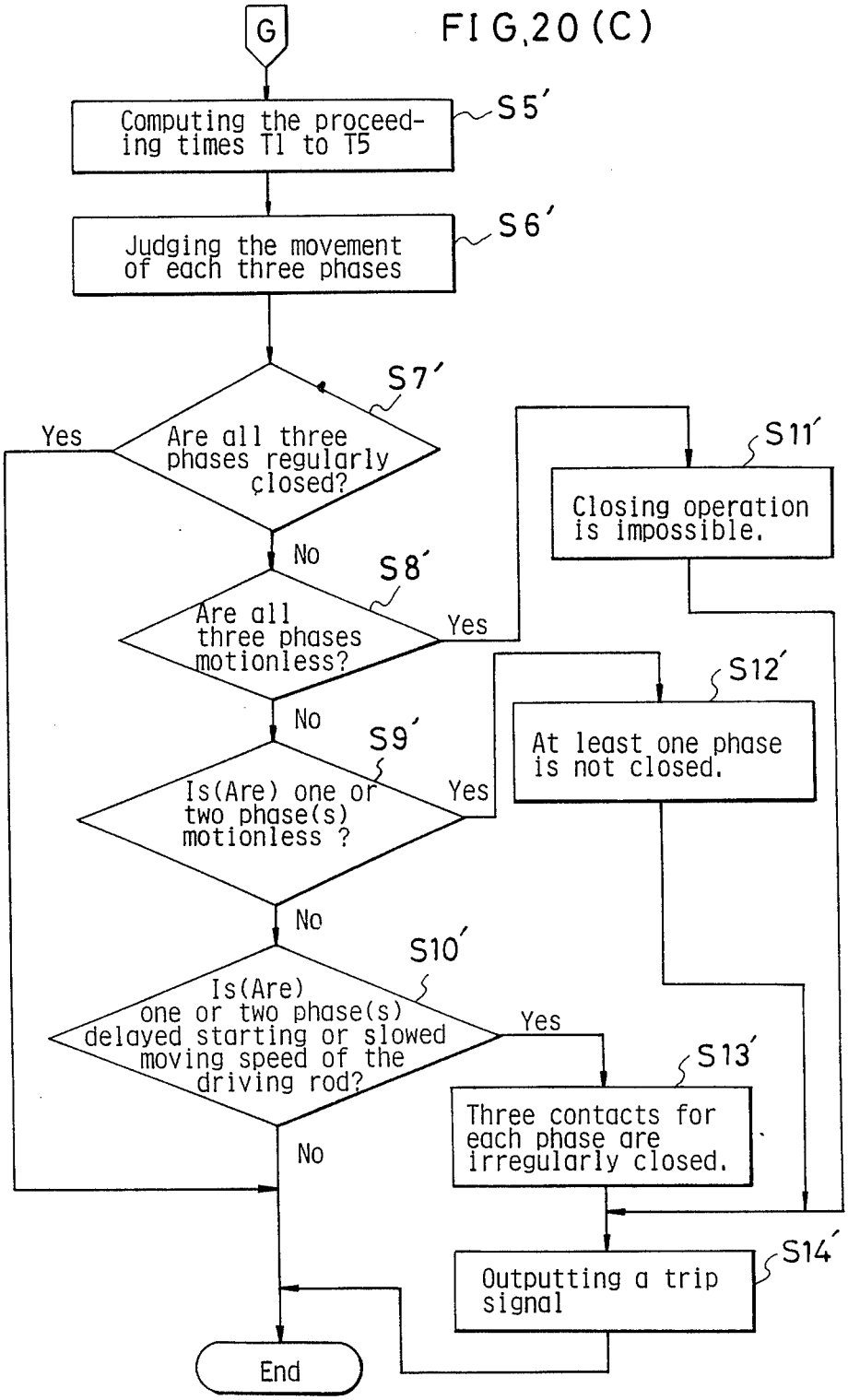
Figure 21:
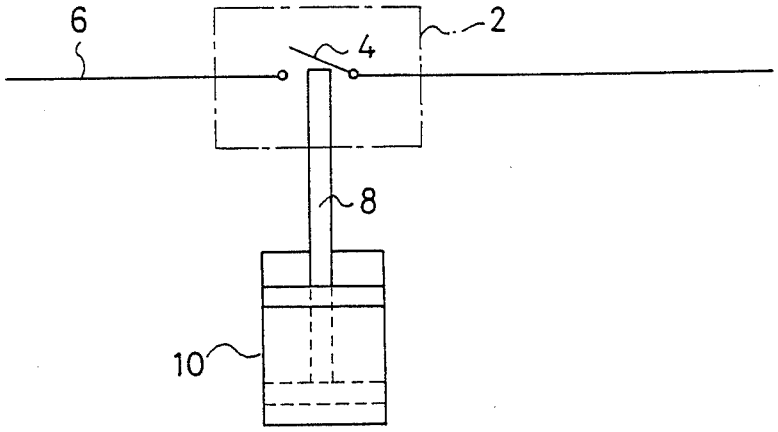
FIG. 21 (PRIOR ART)
FIG. 21 and FIG. 22 are block diagram showing a conventional circuit breaker.
Figure 22:
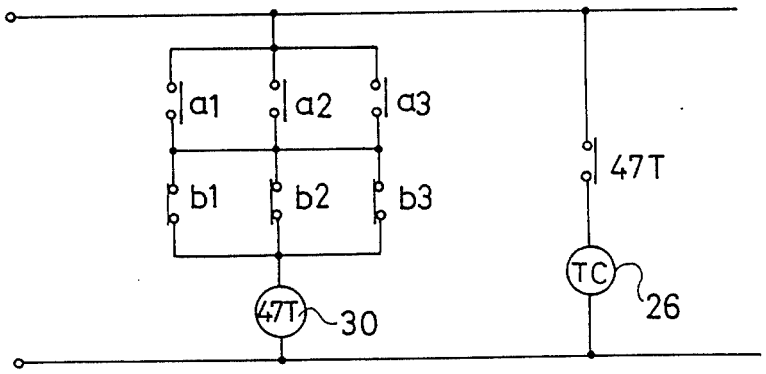
FIG. 22 (PRIOR ART)

The CPU 20 controls the elements in compliance with a program stored in a ROM 18. FIG. 20(A), FIG. 20(B) and FIG. 20(C) are a flow chart depicting the program stored in the ROM 18.

First, the CPU 20 controls the I/O port 16 and stores the output from the current sensor 12 in a RAM 22 (step S1). Second, the CPU 20 stores the outputs from the photo-diodes PD1 to PD5 in the RAM 22 is the same manner (step S2).

Third, the CPU 20 computes a control current supplying time to based on the output from the current sensor 12 in step S3. Fourth, the CPU 20 judges whether the operation is for closing or for breaking in response to the output from the current sensor 12 or 12' (step S4).

The circuit breaking operation of the contact 4 done by the CPU 20 is described in reference to FIG. 20(A) and FIG. 20(B), and the closing operation is shown in FIG. 20(C).

The CPU 20 also computes proceeding times T50, T40, T30, T20 and T10 based on the outputs of the photo-diodes PD5 to PD1 (step 5).

Hereupon, the proceeding time T50 is a time period from a time when a closing signal is applied to the driving mechanism 10 at a case of the contacts being broken to a time when the through-hole 8*a* of the driving rod 8 passes the photo-diode PD5. Also, the proceeding time T40 is a time period from the time when the closing signal is applied to the driving mechanism 10 to a time when the through-hole 8*a* of the driving rod 8 passes the photo-diode PD4. Other proceeding times T30, T20 and T10 are defined similarly. The above-mentioned inputting of the ocntrol signals and computing (steps S1 to S5) is executed for all three phases. The order of function and operation of the CPU 20 in case of closing shown in FIG. 20(C) is simply reverse to those shown in FIG. 20(B). Therefore, a detailed description of FIG. 20(C) is omitted.

Next, the CPU 20 judges whether the driving mechanism is regularly operated or not based on the computed data in the above-mentioned steps (step S6). The judgement of the operation of the driving mechanism is described with reference to FIG. 15 to FIG. 19.

Figure 15:
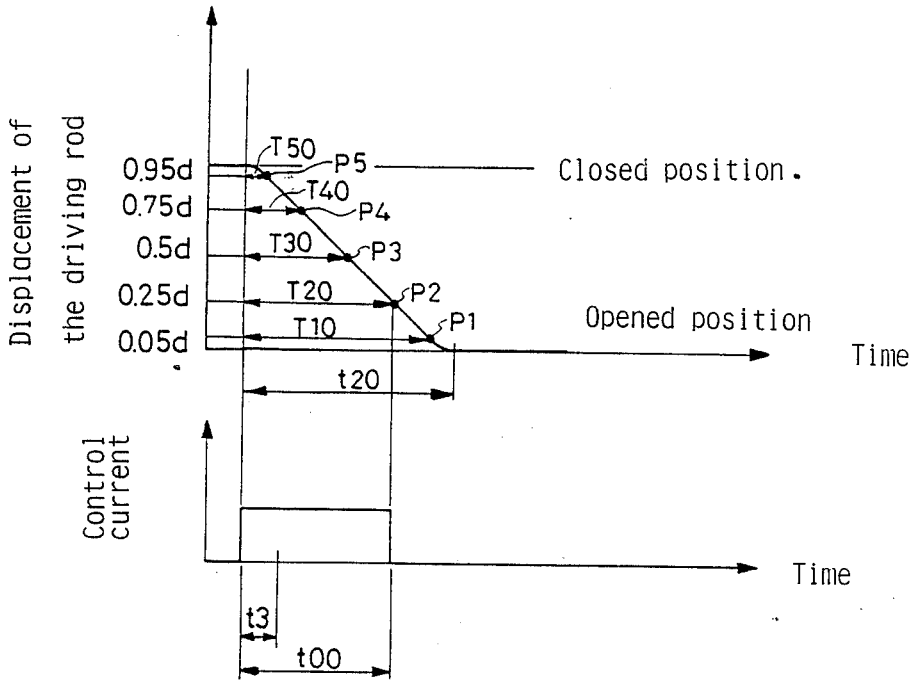
FIG. 15 is a time chart showing normal opening operation of a driving rod 8 in FIG. 14.

FIG. 15 contains time charts which show the relation between the movement of the driving rod 8 and the control current when the closing operation is regularly executed. In this embodiment, the photo-diodes PD5, PD4, PD3, PD2 and PD1 are disposed on positions P5, P4, P3, P2 and P1 which correspond to 5%, 25%, 50%, 75% and 95%, respectively, of full stroke of the driving rod 8 from opening position to closing position. Reference proceeding times T50, T40, T30, T20 and T10 in regular operation and the regular closing time t20 are previously stored in a ROM 18. And a normal current supplying time t00 of the control current and a minimum time t3 (i.e. a required minimum time of supplying control current for making the driving rod 8 move) are previously stored in the ROM 18.

Figure 16:
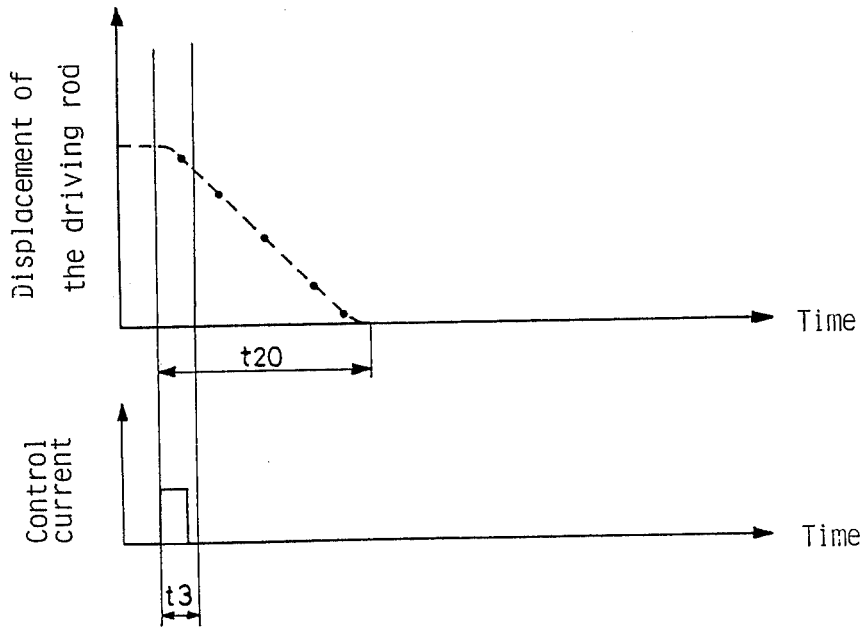
FIG. 16 is a time chart showing an abnormal opening operation of the driving rod 8 in FIG. 14 when the current supplying time is short.

FIG. 16 is a time chart showing the relation between the movement of the driving rod 8 and the control current, when a current supplying time is shorter than the necessary minimum time t3. In this case, the driving rod 8 does not move at all. Since an output from the photo-diode PD1 is not issued even after elapse of the time t20 (which is the regular opening time), the CPU 20 detects that the driving rod 8 is not driven. Though in this embodiment the irregular operation of the driving rod 8 is judged after lapse of the regular opening time t20, alternatively it is possible to make the judgement adopting another elapse time period, for example $\frac{1}{2}$. t20.

Figure 17:
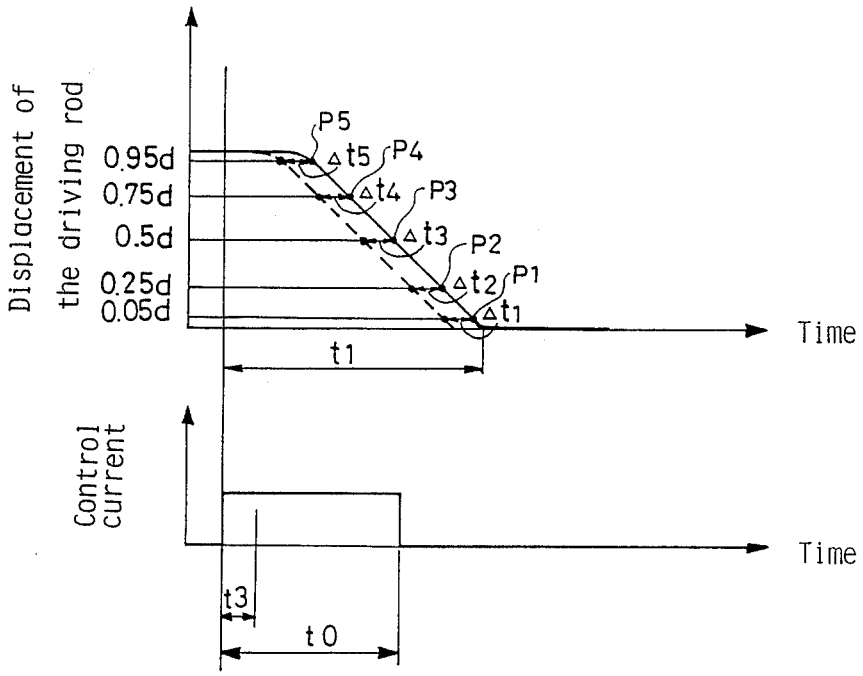
FIG. 17 is a time chart showing an abnormal opening operation of the driving rod 8 in FIG. 14 when the start of the movement of the driving rod is delayed.

FIG. 17 contains time charts showing the relation between the movement of the driving rod 8 and the control current, in case that the start of movement of the driving rod 8 is delayed. In this case, proceeding times T5, T4, T3, T2 and T1 are delayed by delay times Δt5, Δt4, Δt3, Δt2 and Δt1, respectively, in comparison with those in the normal case. When the delay times Δt5 to Δt1 are substantially equal and an opening time t5 is within a time which is twice as long as the regular opening time t20, the CPU 20 judges that the start of the movement of the driving rod 8 is delayed.

Figure 18:
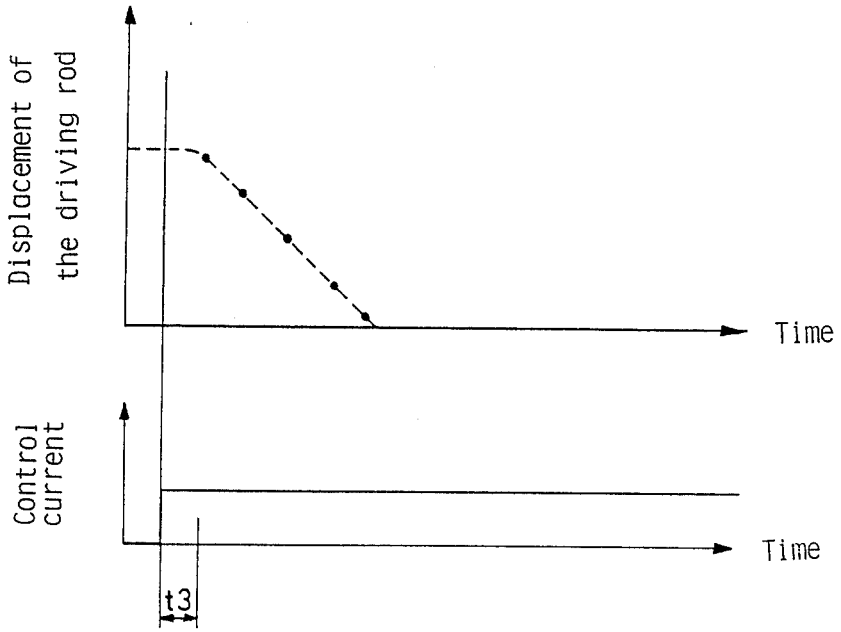
FIG. 18 is a time chart showing an abnormal opening operation of the driving rod 8 in FIG. 14 when the driving rod cannot move in spite of an adequate control current.

FIG. 18 is a time chart showing the relation between the movement of the driving rod 8 and the control current when the driving rod 8 cannot move in spite of control current supply. When the current supplying time t0 is longer than the minimum time t3 and the proceeding times T5 to T1 are longer than a time which is twice as long as normal proceeding times T50 to T10, the CPU 20 judges that the driving rod 8 is not moved.

Figure 19:
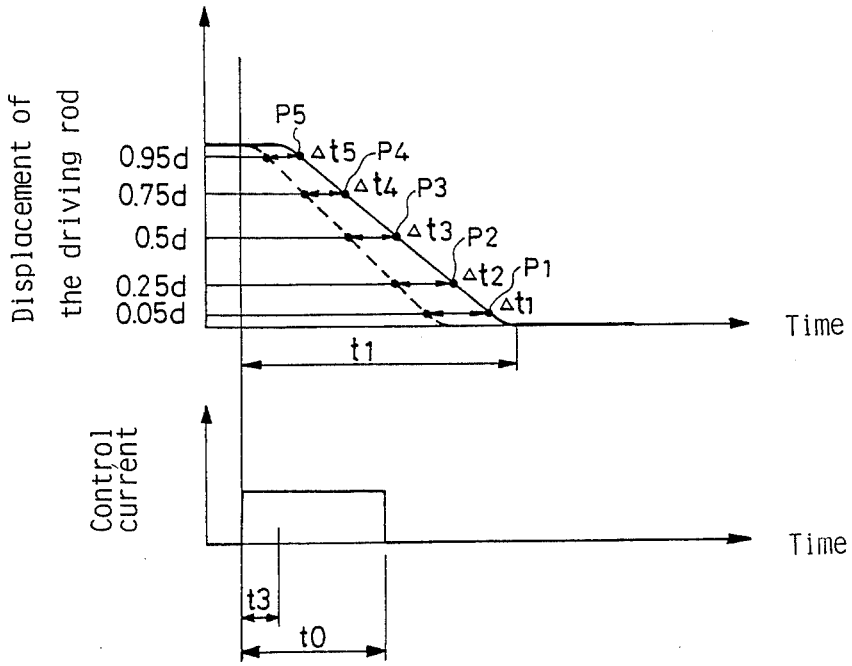
FIG. 19 is a time chart showing an abnormal opening operation of the driving rod 8 in FIG. 14 when the driving rod moves abnormally slowly.

FIG. 19 is a time chart showing the relation between the movement of the driving rod 8 and the control current, when the moving speed of the driving rod 8 is slower than in a normal case due to any reason. When the current supplying time t0 is longer than the minimum time t3 and the delay times Δt5 to Δt1 are becomes long monotonously in this order, for example, $(T3-T2)/(T30-T20)>2$, the CPU 20 judges that the moving speed of the driving rod 8 is slower.

The judgements of the CPU 20 are as tabulated in Table 2 below.

TABLE 2

Judgement for motions of each phases of the power line

| conditions of judgement | judged results: case of regular motion | case of no motion (1) | case of delayed start | case of no motion (2) | case of slowed speed |
|---|---|---|---|---|---|
| $t0 \geqq t3$ | | | | | |
| $t0 \leqq t3$ | | | | | |
| $Ji \sim TiO$ $(i = 1 \sim 5)$ | | | | | |
| $t5 \sim t20$ | | | | | |
| $2\,TiO > Ti > TiO$ $(i = 1 \sim 5)$ | | | | | |
| $\Delta ti \approx$ constant $(i = 1 \sim 5)$ | | | | | |
| $Ti > 2\,TiO$ $(i = 1 \sim 5)$ | | | | | |
| $\frac{T3 - T2}{T30 - T20} > 2$ | | | | | |
| opening operation | | | | | |

Marks shows the cases of judgments designated in the top columns.

In step S6, the CPU 20 executes the above-mentioned judgments for each phases. After that, the CPU 20 judges whether all three phases are normally closed or not in step S7. When the three phases are normally opened, the CPU 20 is over its operation. When the three phases are abnormally broken, the CPU 20 proceeds its operation and judges impossibility of opening, open phase or opening of inuniformity in steps S8, S9 and S10. When the CPU 20 judges that an open phase or nonuniform opening occurs, it judges whether current supplying time t0 of the control current is longer than the minimum time t3 or not in steps S11', S12' and S13'. When the $t0 \geqq t3$, the CPU 20 judges that the driving mechanism 10 is out of order and issues a trip signal to another breaker serving as a spare protection system by passing through the I/O port 24 and the photo-electro converter 27. Next, when $t0 < t3$, the CPU 20 judges that a problem has occured on control circuit 14 and issues a trip signal for tripping itself to the tripping coil 26 by passing through the I/O port 24.

When the circuit breaker shown in FIG. 14 serves as a spare protection breaker for another circuit breaker system and a trip signal is issued from another CPU (not shown in the figure), the trip signal is applied to the photo-electro converter 27' by passing through an optical fiber (not shown) and the optical fiber connector 28'. The trip signal is converted to an electric signal by the photo-electro converter 27' and applied to the CPU 20 by passing through the I/O port 16. The CPU 20 drives the tripping coil 26 by following a predetermined program (not shown).

Although the invention has been described in its preferred form with a certain degree of particularity, it should be understood that the present disclosure of the preferred embodiments may be changed in the details of construction and the combination and other arrangements of parts may be resorted to without departing from the spirit and the scope of the invention as hereinafter claimed.

What is claimed is:

1. A circuit breaker, comprising:

at least one contact for opening and closing a phase of an electric power line;

an operation member for opening and closing said contact;

driving means for driving said operation member upon reception of a control signal;

control signal detecting means for detecting whether or not said control signal is applied to said driving means;

operation detecting means for detecting a movement of said operation member;

memory means for storing at least a regular control signal and a normal moving process of said operation member;

judging means for judging whether opening or closing operation of said contact is normally made or not, based on comparison among detected signals of said contol signal detecting means and said operation detecting means and said regular control signal and said stored data of said normal moving process of said operation member stored in said memory means; and operation correcting means for correcting an abnormal state of said closing operation when said judging means detects an abnormal state of said contact, said moving member or said driving means.

2. A circuit breaker, comprising;

at least one contact for opening and closing a phase of an electric power line;

an operation member for opening and closing said contact;

driving means for driving said operation member upon reception of a control signal;

control signal detecting means for detecting whether or not said control signal is applied to said driving means or not;

operation detecting means for detecting a movement of said operation member, memory means for storing at least a regular control signal and a normal moving process of said operation member;

judging means for judging whether opening or closing operation of said contact is normally made or not, based on comparison among detected signals of said control signal detecting means and said operation detecting means and said regular control signal and stored data of said normal moving process of said operation member stored in said memory means; and operation correcting means for correcting an abnormal state of said closing operation when said judging means detects an abnormal state of said contact, said moving member or said driving means, wherein said control signal detecting means comprises a photo-diode array and a light emitting diode array disposed facing to corresponding photo-diodes to receive light disposed on said operation member in such a manner as to cross a space between said photo-diode array and said light emitting diode array.

3. A circuit breaker, comprising:

at least one contact for opening and closing a phase of an electric power line;

an operation member for opening and closing said contact;

driving means for driving said operation member upon reception of a control signal;

control signal detecting means for detecting whether or not said control signal is applied to said driving means;

operation detecting means for detecting a movement of said operation member;

a current sensor for detecting a current flow in said electric power line and providing a corresponding output signal;

memory means for storing data on at least a regular control signal and a normal moving process of said operation member;

judging means for judging whether or not an opening or closing of said contact is normally made, based on comparison among detected signals of said control signal detecting means, said current sensor and said operation detecting means and said regular control signal and said memorized data of said normal moving process of said operation member stored in said memory means; and operation correcting means for correcting an abnormal state of said closing member when said judging means detects an abnormal state of said contact, said moving member or said driving means.

4. A circuit breaker, comprising:

at least one contact for opening and closing a phase of an electric power line;

an operation member for opening and closing said contact;

driving means for driving said operation member upon reception of a control signal;

control signal detecting means for detecting whether or not said control signal is applied to said driving means;

operation detecting means for detecting a movement of said operation member;

a current sensor for detecting a current flow in said electric power line and providing a correspond output signal;

memory means for storing data on at least a regular control signal and a normal moving process of said operation member;

judging means for judging whether or not an opening or closing of said contact is normally made, based on comparison among detected signals of said control signal detecting means, said current sensor and said operation detecting means and said regular control signal and said memorized data of said normal moving process of said operation member stored in said memory means; and operation correcting means for correcting an abnormal state of said closing member when said judging means detects an abnormal state of said contact, said moving member or said driving means;

said control signal detecting means comprising a photo-diode array and a light emitting diode array disposed facing to corresponding photo-diodes to receive light therefrom and further comprises a marker for intercepting said lights and disposed on said operation member in such a manner as to cross a space between said photo-diode array and said light emitting diode array.

5. A circuit breaker, comprising:

at least one contact for opening and closing a phase of an electric power line;

an operation member for opening and closing said contact;

driving means for driving said operation member upon reception of a control signal;

control signal detecting means for detecting whether or not said control signal is applied to said driving means;

operation detecting means for detecting a movement of said operation member;

memory means for storing data on at least a regular control signal and a normal moving process of said operation member;

judging means for judging whether or not an opening or closing operation of said contact is normally made, based on comparison among detected signals of said control signal detecting means and said operation detecting means and said regular control signal and memorized data of said normal moving process of said operation member stored in said memory means; and protecting control means for issuing a tripping signal to one of said driving means in a closing operation of said contact and another protection means in an opening operation of said contact when movement of said operation member is judged as an abnormal movement by said judging means.

6. A circuit breaker in accordance with claim 5, wherein:

said protection control means issues a tripping signal to said driving means when said protection control means receives a tripping signal from said other spare protection means .

7. A circuit breaker in accordance with claim 5, wherein:

said control signal detecting means comprises a photo-diode array and a light emitting diode array disposed to face a corresponding array of photo-diodes to receive light therefrom and further comprises a marker for intercepting said light disposed on said operation member in such a manner as to cross a space between said photo-diode array and said light emitting diode array.

* * * * *